US007077172B2

(12) United States Patent
Perkitny et al.

(10) Patent No.: US 7,077,172 B2
(45) Date of Patent: Jul. 18, 2006

(54) WASTE COLLECTION DEVICE

(76) Inventors: Jerzy Perkitny, 17810 Lake Rd., Lakewood, OH (US) 44107; Sidney R. Good, 2043 Random Rd. #07, Cleveland, OH (US) 44106

( * ) Notice: Subject to any disclaimer, the term of this patent is extended or adjusted under 35 U.S.C. 154(b) by 147 days.

(21) Appl. No.: 10/811,103

(22) Filed: Mar. 26, 2004

(65) Prior Publication Data

US 2004/0188443 A1 Sep. 30, 2004

Related U.S. Application Data

(60) Provisional application No. 60/476,686, filed on Jun. 6, 2003, provisional application No. 60/458,594, filed on Mar. 28, 2003.

(51) Int. Cl.
*B65B 1/04* (2006.01)

(52) U.S. Cl. ..... 141/10; 141/313; 141/114; 294/1.3

(58) Field of Classification Search ..... 141/10, 141/114, 313, 391, 108, 110; 294/1.3–1.5, 294/55

See application file for complete search history.

(56) References Cited

U.S. PATENT DOCUMENTS

| | | | | |
|---|---|---|---|---|
| 3,744,453 | A * | 7/1973 | Deitch | 294/1.5 |
| 3,819,220 | A | 6/1974 | Bredt | |
| 3,977,422 | A | 8/1976 | Cabaluna | |
| 4,078,838 | A | 3/1978 | Nadratowski | |
| 4,143,899 | A * | 3/1979 | Wetherall et al. | 294/50.9 |
| 4,185,355 | A | 1/1980 | Williams | |
| 4,253,691 | A | 3/1981 | Liu | |
| 4,447,082 | A | 5/1984 | Lindholm | |
| 4,477,111 | A | 10/1984 | Crooks | |
| 4,478,448 | A | 10/1984 | Albert | |
| 4,641,873 | A | 2/1987 | Nurnberger | |
| 4,819,977 | A | 4/1989 | Cooper | |
| D310,436 | S | 9/1990 | Krauth | |
| 4,995,661 | A | 2/1991 | Aurness et al. | |
| 5,156,427 | A | 10/1992 | Longrie et al. | |
| 5,335,952 | A | 8/1994 | Clapper | |
| 5,382,063 | A | 1/1995 | Wesener et al. | |
| 5,390,628 | A | 2/1995 | Vito | |
| 5,540,469 | A | 7/1996 | Albert | |
| 5,540,470 | A | 7/1996 | Lu | |
| 5,580,111 | A | 12/1996 | Bohn | |
| D377,247 | S | 1/1997 | Albert | |
| 5,661,873 | A | 9/1997 | Karet | |
| 5,868,447 | A | 2/1999 | Clark et al. | |
| 6,032,995 | A | 3/2000 | Barbaro | |
| 6,196,601 | B1 | 3/2001 | Juntunen, Jr. | |

(Continued)

FOREIGN PATENT DOCUMENTS

| | | |
|---|---|---|
| FR | 2 650 608 | 2/1991 |

(Continued)

*Primary Examiner*—Steven O. Douglas
(74) *Attorney, Agent, or Firm*—Fay, Sharpe, Fagan, Minnich & McKee, LLP

(57) ABSTRACT

A waste collection device includes a body including a housing defining an opening. The housing opening allowing an open end of an associated bag to be folded thereover and a housing receiving a closed end of the associated bag therein. A pulling mechanism is connected to the body and removably connected to the associated bag for selectively pulling the associated bag into the housing. To use, the open end of the bag is positioned adjacent waste material to be collected. The pulling mechanism then pulls the bag into the housing and the waste material is simultaneously transferred into the bag.

40 Claims, 35 Drawing Sheets

U.S. PATENT DOCUMENTS

| | | | |
|---|---|---|---|
| 6,216,314 | B1 | 4/2001 | Dangerfield |
| 6,305,322 | B1 | 10/2001 | Patel |
| 6,439,627 | B1 | 8/2002 | Devane |
| 6,618,898 | B1 | 9/2003 | Tingle |

FOREIGN PATENT DOCUMENTS

| | | |
|---|---|---|
| GB | 2 227 645 | 8/1990 |
| WO | WO 93/20285 | 10/1993 |

* cited by examiner

WASTE COLLECTION DEVICE

This application claims the benefit of and hereby expressly incorporates herein by reference U.S. Provisional Patent Application Nos. 60/458,594, filed Mar. 28, 2003 and 60/476,686, filed Jun. 6, 2003.

BACKGROUND OF THE INVENTION

1. Field of the Invention

The present invention relates to a waste collection device. More particularly, the present invention relates to a motorized waste collection device that employs a disposable liner bag to mechanically remove waste or debris (which can be liquid, solid or semi-solid) from a surface to be cleaned. The waste collection device and the liner bag find application in a variety of configurations and will be described with particular reference to several of these configurations. However, it is to be appreciated that the invention may relate to other similar environments and applications.

2. Description of the Prior Art

A wide variety of types of waste collection devices are generally well known. One representative example of such a waste collection device is disclosed in U.S. Pat. No. 5,382,063 to Wesener et al. The '063 patent is directed to a waste product collection device for removing relatively small volumes of waste product from a surface. The '063 device includes a housing having an opening at one end and a handle mounted on a top surface thereof. To operate, a user places the opening of the device adjacent the material or waste to be collected and scoops the waste into the opening. A flexible lip is provided along the bottom of the opening to assist in the scooping of the waste. The device further includes a lid pivotally secured to the housing for covering the opening after the waste is collected therein. A disposable bag is disclosed for use with the device.

One drawback of the '063 device is that the scooping motion required to collect the waste can result in the waste being flung away from the device rather than into it. Further, the scooping motion may make it difficult for a user to force the waste into the opening. This is particularly evident when the device is used to pick-up waste that is semi-solid such as, for example, spilled yogurt. The scooping motion pushes the semi-solid waste around and does not generally facilitate waste removal.

While some known devices, such as the one illustrated in U.S. Pat. No. 4,078,838 to Nadratowski, are so designed as to pull a liner into a housing together with the debris picked up by the liner, these devices also have drawbacks. For example, the debris can fall out of the housing since the housing is held at a fairly steep angle in relation to the surface from which the debris is picked up. Also, the housing only presents a narrow opening adjacent the surface so that wider debris pieces or waste are difficult to pick up cleanly.

Accordingly, there is a need for a waste collection device that is easy to use and is able to remove waste even when in a semi-solid state. It is desirable for such a device to be easily usable with a liner so as to reduce the need for cleaning the device after each use. It is further desirable that the liner draw the waste into the device so as to reduce the mess on the surface being cleaned. Optionally, such a device can further include one or more of the following features: ability to be handheld, operated by batteries, ability to fold-up for compact storage, include storage for additional liners, provide illumination and include a means for preventing removed waste from escaping the device.

SUMMARY OF THE INVENTION

The present invention provides a new and improved waste collection device that overcomes the foregoing difficulties and others and provides the aforementioned and other advantageous features. More particularly, in accordance with one aspect of the present invention, the waste collection device includes a body including a housing defining an opening. The housing opening allows an open end of an associated bag to be folded thereover and the housing receives a closed end of the associated bag therein. A pulling mechanism is connected to the body and removably connected to the associated bag for selectively pulling the associated bag into the housing.

In accordance with another aspect of the present invention, a waste collection device is provided. More particularly, in accordance with this aspect of the invention, the waste collection device includes a body including a housing defining an opening. A liner bag has a closed end that is received in the opening. The liner bag also has an open end folded over the opening portion. A spool is rotatably connected to the body and removably connected to the closed end of the liner bag. Rotation of the spool in a first direction pulls the liner bag into the opening.

In accordance with still another aspect of the present invention, a waste collection device is provided. More particularly, in accordance with this aspect of the invention, the waste collection device includes a body defining an opening. A liner has a closed end received in the opening and an open end received about the body adjacent the opening. A spool is rotatably mounted in the body and connected to the liner so that, upon rotation of the spool in a first direction, the liner is pulled into the body. A motor is mounted to the body and selectively connected to the spool for powered rotation of the spool in a first direction.

In accordance with still yet another aspect of the present invention, a method of collecting waste is provided. More particularly, in accordance with this aspect of the invention, a housing is provided with an opening and a pulling mechanism located in the opening. A liner bag having a bag closed end and a bag open end is mounted to the housing such that the bag closed end is located in the opening. The bag closed end is connected with the pulling mechanism. The bag open end is folded over the opening. The opening with the bag open end folded thereover is positioned adjacent waste material to be collected. The waste material is located on a surface. The bag is pulled into the housing with the pulling mechanism. The waste material is simultaneously transferred from the surface into the bag.

BRIEF DESCRIPTION OF THE DRAWINGS

The invention may take physical form in various components and arrangements of components, and in various steps and arrangements of steps. The drawings are only for purposes of illustrating preferred embodiments of the invention and are not to be construed as limiting the invention.

DETAILED DESCRIPTION OF THE INVENTION

Figure 1:
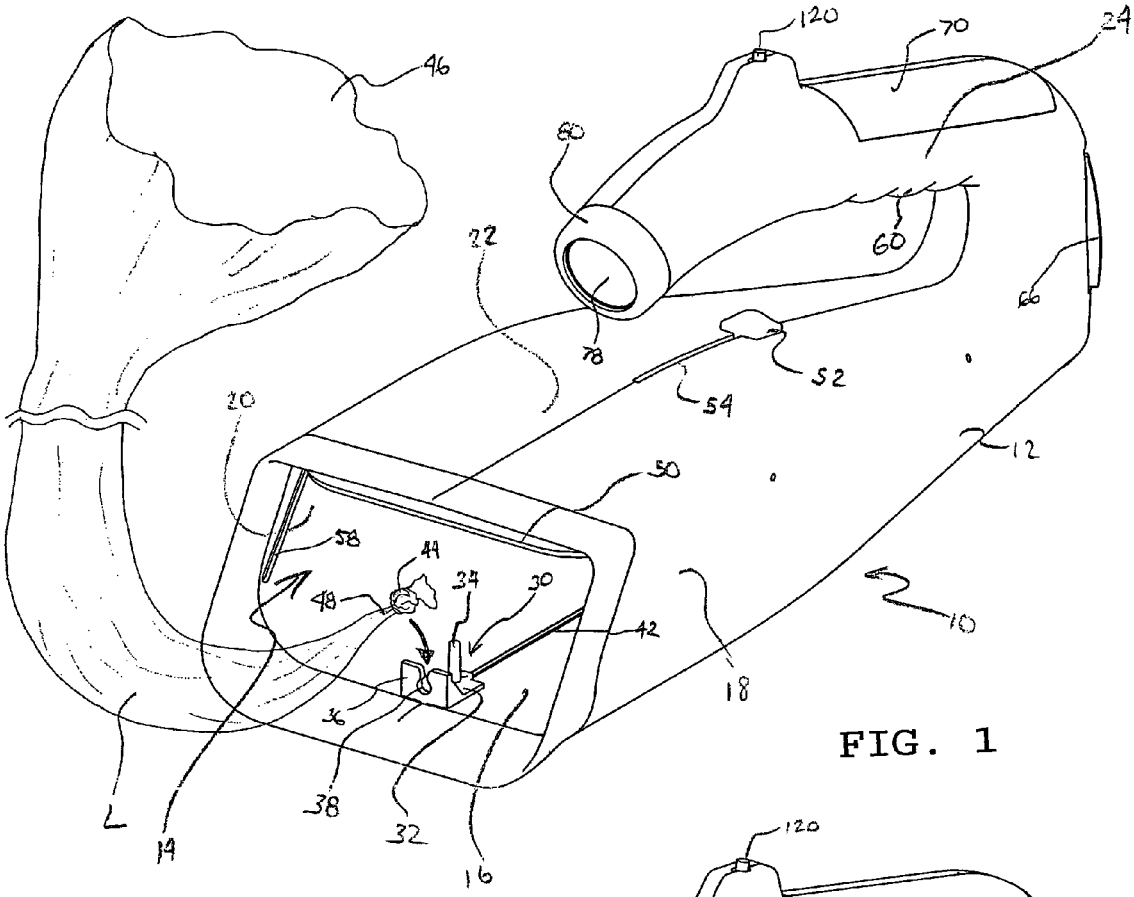
FIG. 1 is a front perspective view of a waste collection device according to one embodiment of the present invention with a liner having a balled end about to be inserted into a slot of a carriage located adjacent an opening of a housing.

Referring now to the drawings wherein the showings are for purposes of illustrating preferred embodiments of the invention only and not for purposes of limiting the same, FIG. 1 shows a waste collection device according to one preferred embodiment of the present invention generally designated by reference numeral 10. The device 10 includes a body having a handle 24 and a housing 12 having or defining a wide mouth opening 14 at one end thereof. The housing 12 is formed of a substantially flat lower wall 16, a pair of side walls 18,20 and an upper wall 22. From an end opposite the opening 14, a handle member 24 curls around to a position spaced above the upper wall 22. Of course, the configuration of the housing 12 and handle 24 are not limited by the device shown and described and it is to be appreciated that the housing 12 and handle 24 could have alternate configurations that are to be considered within the scope of the present invention. For example, other configurations include without limitation the housing 12 being cylindrical or abbreviated in length, the handle 24 extending from another part of the housing 12 or formed in the housing 12, the housing having an extra wide mouth opening that is relatively shorter in height than opening 14 of the illustrated embodiment, etc. However, in any configuration, it is advantageous to have a wide and/or flat lower wall for purposes of removing waste and, in particular, semi-solid waste.

Figure 3:
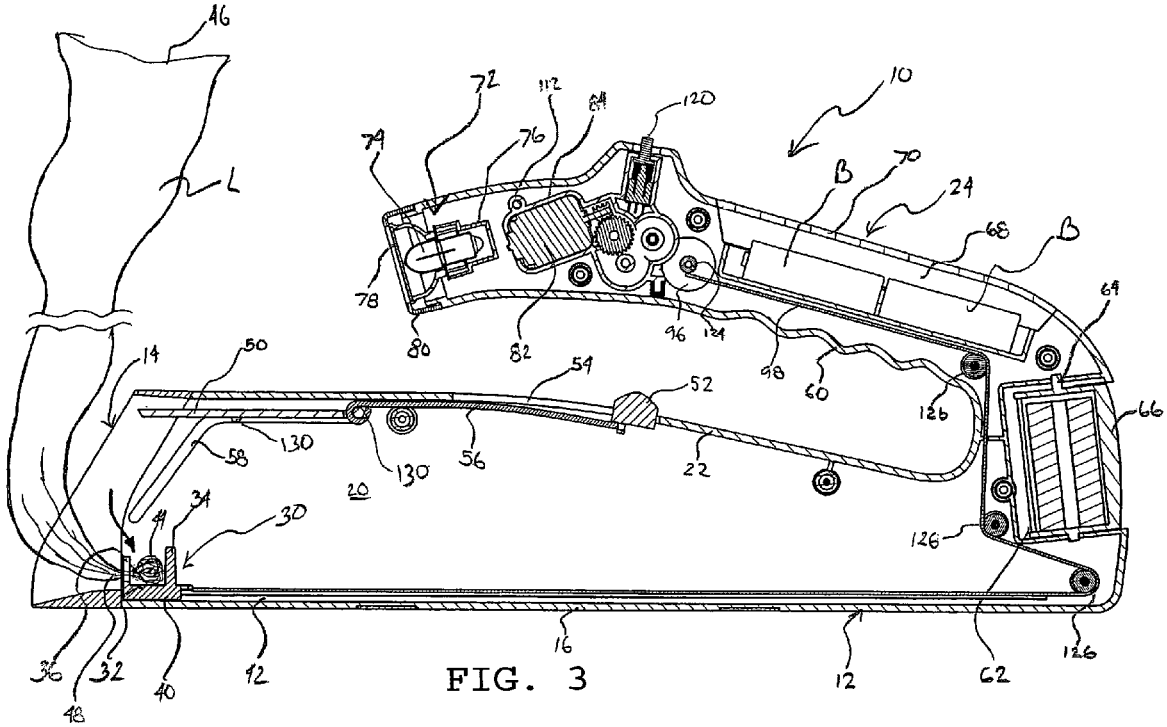
FIG. 3 is a cross-sectional view of the waste collection device of FIG. 1 showing the balled end of the liner in the slot of the carriage.
Figure 13:
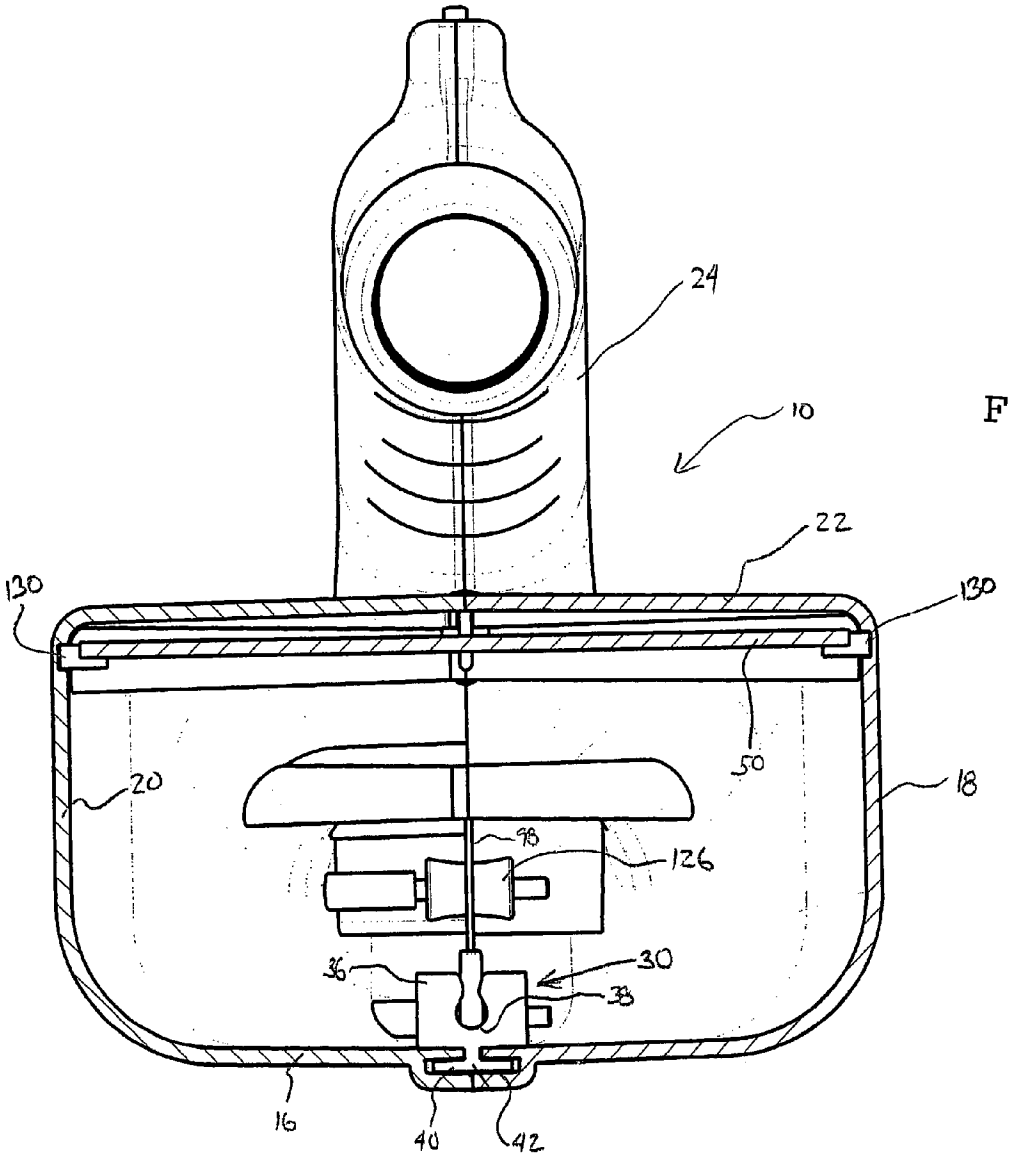
FIG. 13 is a front end elevational view of the waste collection device of FIG. 1.

With additional reference to FIG. 3, the device 10 further includes a pulling mechanism connected to the housing 12. As used herein, mechanism refers to an arrangement of machine parts or a system of parts that interact or operate like those of a machine. The pulling mechanism includes a carriage 30 slidably connected to the lower wall 16 for receiving one end of a liner, bag or liner bag L. The carriage 30 is adapted to assist in loading the liner L into the device 10 and picking-up waste or debris as will be described in more detail below. The carriage 30 includes a base 32 and a means for releasably or removably connecting the liner L thereto. The means for releasably connecting the liner L to the carriage 30 includes (1) a post 34 and (2) a wall and slot arrangement having a wall 36 extending upward from the base 32 and a slot 38 (FIG. 1) defined in the wall 36. With additional reference to FIG. 13, the carriage 30 further includes an engaging portion 40 that is received within a carriage slot 42 defined along the lower wall 16 parallel to a longitudinal length of the housing 12.

With specific reference to FIGS. 1 and 3, the liner L is generally a bag-like container having a closed end 44 and an open end 46. The closed end 44 of the liner L can be a balled-together portion of the liner L. This allows the liner L to be formed of a tubular, flexible material similar to a conventional trash bag. More specifically, one end of the tubular, flexible material is balled together to form the closed end 44 of the liner L. The other end 46 remains open so that the liner L can receive waste or debris therein. As shown in FIG. 3, the balled end 44 of the liner L is receivable in the slot 38 of the carriage 30. More specifically, an area 48 of the liner L immediately forward of the balled end 44 passes through the slot 38 and the balled end 44 is placed immediately behind the wall 36. In this manner, an axial pullout force on the liner L in a direction generally parallel to the slot 42 will not remove the liner L from the carriage 30. Similarly, movement of the carriage 30 into the housing 12 will pull the liner L into the opening 14 because the wall 36 will force the balled end 44 into the housing 12.

With continuing reference to FIGS. 1 and 3, the device 10 also includes a closure structure or door 50 for closing the opening 14 when the door 50 is moved to a closed position. The door 50 is shown in an open position in FIGS. 1 and 3 wherein the door 50 generally does not obstruct the opening 14. As will be described in more detail below, the door 50 is moved between its open and closed positions by a slidably received knob 52. The knob 52 is slidably received or engaged in a slot 54 formed in the upper wall 22 of the housing 12. The knob 52 is connected to the door 50 by a link 56. When the knob 52 is used to move the door 50 via the link 56, the door 50 moves along a pair of tracks or grooves 58 (only one shown in FIGS. 1 and 3) formed in the side walls 18,20 as will be described in more detail below.

Figure 9:
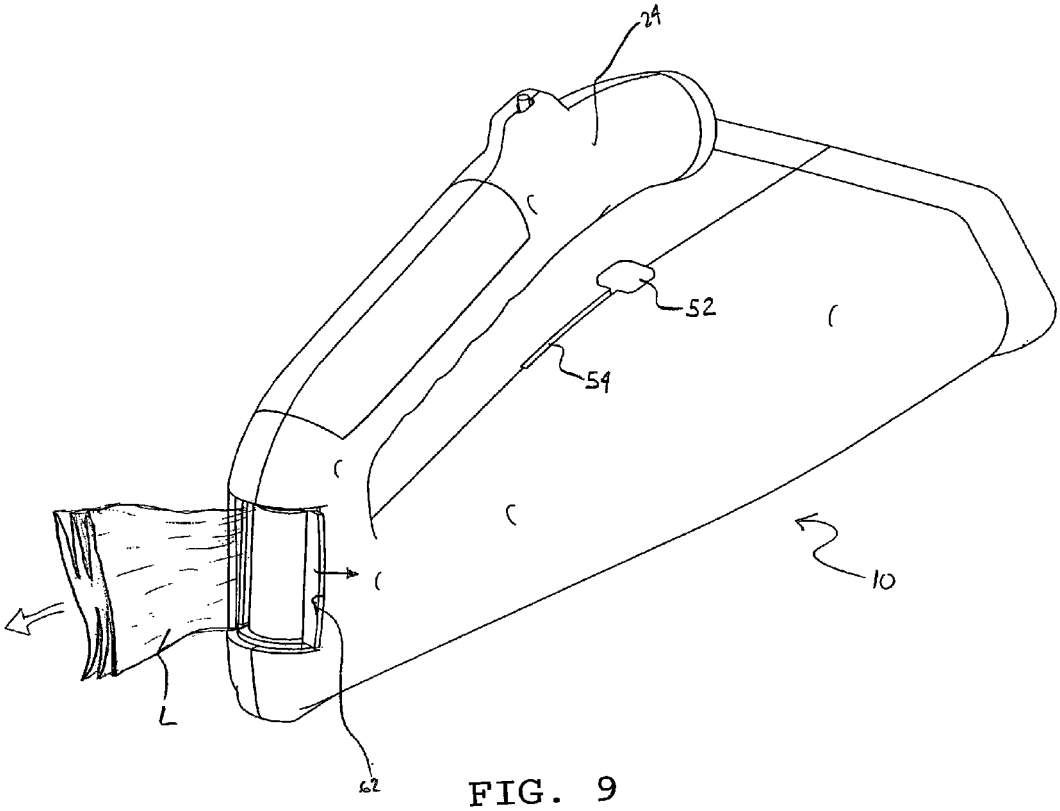
FIG. 9 is a rear perspective view of the waste collection device of FIG. 1 showing a storage compartment for holding one or more liners.

The handle 24 includes several functional features. More specifically, the handle 24 includes a contoured portion 60 formed on an underside thereof so a user is better able to hold and operate the device 10. With additional reference to FIG. 9, a storage compartment 62 can be formed in a lower portion of the handle 24 adjacent the housing 12 for storing a plurality of liners L on a roll or spool 64 rotatably mounted within the storage compartment 62. The storage compartment 62 is accessible through a storage compartment cover or door 66. A battery storage compartment 68 can be formed in a middle portion of the handle 24 adjacent the gripping portion 60. The battery storage compartment 68 can be configured to operatively receive one or more batteries B such as a pair of conventional M alkaline batteries. The battery compartment 68 is accessible through a battery storage compartment cover or door 70.

A forward portion of the handle 24, i.e., the portion of the handle 24 closest to the opening 14, can include a lighting assembly 72. The lighting assembly 72 includes a light source 74, such as a conventional battery powered light bulb, that produces a light beam. The light source 74 is received in a socket 76 of the handle 24 and is oriented such that the light beam is directed through a transparent cover piece 78 to illuminate an area in front of or adjacent the opening 14. The light source 74 can be selectively electrically connected to the batteries B for providing power thereto. A cap member 80 is threadedly received on the handle 24 to retain the cover piece 72 in position and provide access to the light source 74 such as might be needed for replacement purposes. Of course, the handle 24 of the device 10 can alternately be constructed without a lighting assembly.

With reference back to FIG. 3, between the batteries B and the lighting assembly 72, the handle 24 includes a driving mechanism including a motor 82 such as a conventional battery-powered electric motor. The motor 82 is held in position by a housing 84 pivotally mounted within the handle 24. The motor 82 can be selectively electrically connected to the batteries B for providing power thereto. The driving mechanism and, specifically, the motor 82 is connected to the carriage 30 for providing powering pulling movement thereof by a transmission assembly of the driving mechanism which serves to convert rotational power from the motor 82 to linear movement of the carriage 30.

Figure 10:
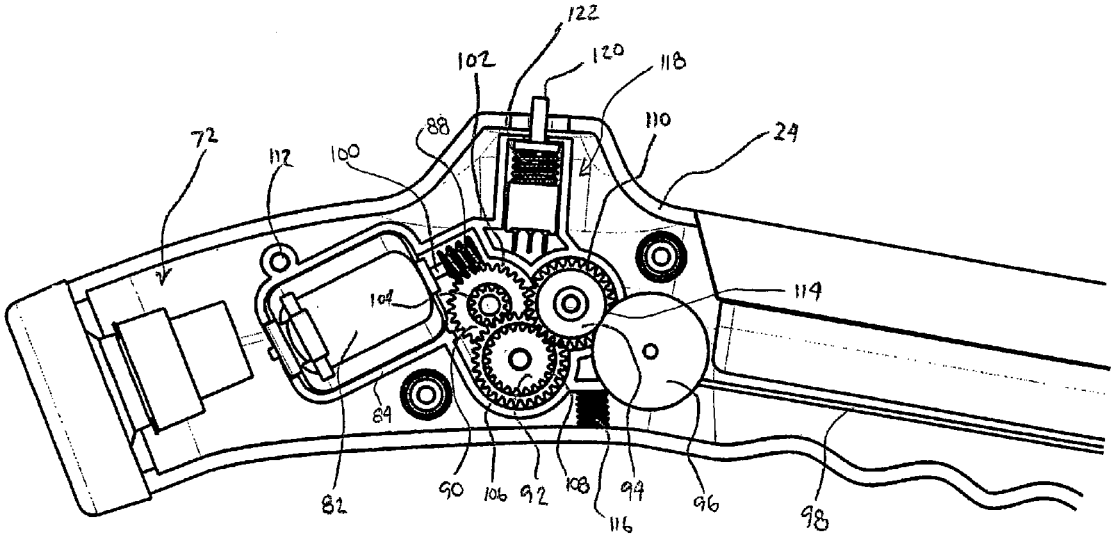
FIG. 10 is an enlarged partial cross-sectional view of a portion of the waste collection device of FIG. 1 showing a driving mechanism for the carriage.

With reference to FIG. 10, the transmission assembly includes a plurality of gears and/or rollers 88,90,92,94 that selectively rotate a spool 96 of the transmission assembly. A flexible connecting element 98 of the transmission assembly, such as string or the like, extends between the spool 96 and the carriage 30. Thus, the connecting element 96 is connected at one end to the carriage 30 and at another and to the spool 96. When the spool 96 is rotated in a first direction by the motor 82, the string 98 winds around the spool 96 and pulls the carriage 30 inward from the opening 14. When the spool 96 is manually rotated in a second, opposite direction, by movement of the carriage 30 toward the opening 14, the string 98 unwinds from the spool 96.

More specifically, the motor 82 includes an output shaft 100 having a worm gear 88 formed at a distal end thereof. The worm gear 88 includes a tooth or threads that are engaged with teeth of an outer gear portion 102 of a first step gear 90. Teeth of an inner gear portion 104 of the first step gear 90 are engaged with teeth of an outer gear portion 106 of a second step gear 92. The second step gear 92 includes an inner gear portion 108 having teeth engaged with teeth of an outer gear portion 110 of a compound gear and roller member 94. All of the plurality of gears 88–94 are contained within the pivotally mounted housing 84.

The housing 84 is pivotally connected to the handle 24 by, and movable about, a pivot 112. More specifically, the housing 84 is pivotally movable between a first position wherein an inner roller member or force transfer roller 114 of the compound gear and roller member 94 is disengaged from the spool 96 and a second position wherein the inner roller member 114 is frictionally engaged with the spool 96 such that rotation of the compound member 94 will cause rotation of the spool 96. The device 10 includes a means for disengaging the force transfer roller 114 from the spool 96 to allow free rotation of the spool 96. In the illustrated embodiment, the means for disengaging the force transfer roller includes a first biasing member 116, such as a spring, provided in the handle 24. The spring 116 urges the housing 84 toward the first, disengaged, position.

A switch assembly 118 is also provided in the handle 24 for moving the housing 84 toward the second, engaged position against the force of the first biasing member 116. The switch assembly 118 includes an actuator or knob 120 protruding from a surface of the handle 24. The actuator 120 is movable from a normal, extended position to a first, depressed position and a second, further depressed position. In the second, further depressed position, the actuator 120 causes the switch assembly 118 to move the housing 84 toward its second, engaged position, overcoming the force of the first biasing member 116.

Figure 11:
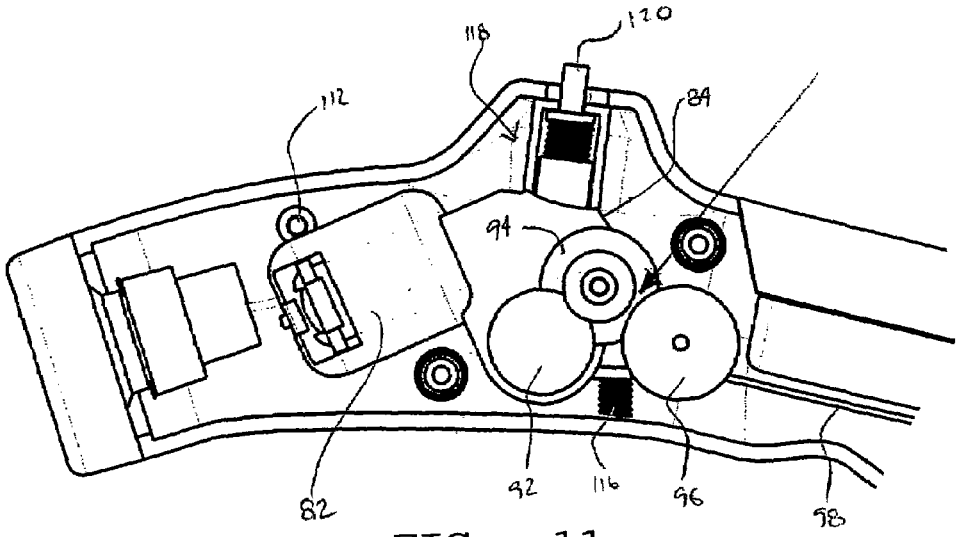
FIG. 11 is an enlarged partial cross-sectional view of the waste collection device of FIG. 1 showing the driving mechanism in a disengaged position.
Figure 12:
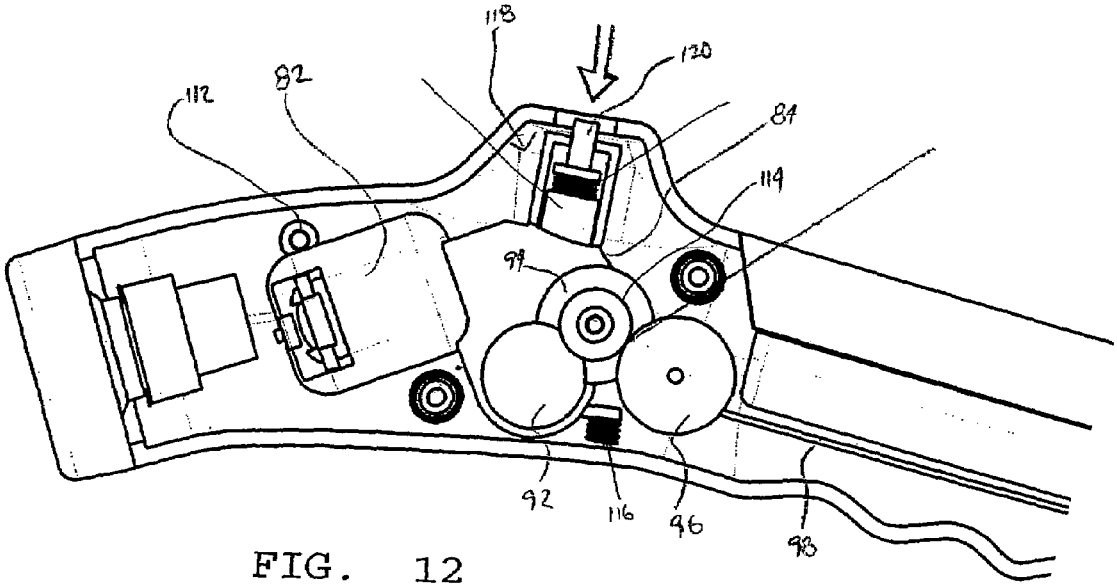
FIG. 12 is an enlarged partial cross-sectional view of the waste collection device of FIG. 11 showing the driving mechanism in an engaged position.

Thus, with reference to FIG. 11, when the actuator 120 is not depressed, the first biasing member 116 maintains the housing 84 in its first, disengaged position and the roller member 114 does not frictionally engage the spool 96. However, with reference to FIG. 12, when the actuator 120 is depressed to the second position, the switch assembly 118 moves the housing 84 against the force of the first biasing member 116 into its second, engaged position and the roller member 114 frictionally engages the spool 96. In the second, engaged position, the motor 82 is connected to the spool 96 and can rotate it through the above-described gear arrangement. Once the actuator 120 is no longer depressed to the second position, the housing 84 returns to its first, disengaged position by force of the first biasing member 116 and the motor 82 is no longer connected to the spool 96 for rotation thereof.

Referring back to FIG. 10, the actuator 120 of the switch assembly 118 also serves as an electrical switch between (1) the batteries B and the light source 74 and (2) the batteries B and the motor 82. More specifically, when the actuator 120 is depressed to the first position, power is allowed to flow from the batteries B to the light source 74 to illuminate the area adjacent the opening 14 and power is allowed to flow from the batteries to the motor 82 to rotate the drive shaft 100. Alternatively, power is only allowed to flow to the motor 82 when the actuator 120 is depressed to the second position or at a position between the first and second positions. Of course, a separate switch could also be used to selectively actuate the light source. In any case, the power allowed to flow upon depression of the actuator 120 to the first position continues to be allowed to flow upon further depression to the second position.

The switch assembly 118 further includes a second biasing member 122, such as a spring, that urges the actuator 120 toward the extended position. Accordingly, when a user is no longer depressing the actuator 120 and, if in the second position, overcoming the force of the second biasing member 122, the actuator 120 returns to its extended position. In the extended position, the electrical connections from the batteries B to the light source 74 and the motor 82 are interrupted. If desired, two switches or actuators could be employed. Although batteries are shown and described as the power source for powering the light source 74 and the motor 82, it is to be appreciated that any other power source could be used in place of the batteries B. For example, the device 10 could be alternatively configured to operate using conventional AC power or rechargeable batteries.

With reference to FIG. 3, the spool 96 includes a barrel 124 to which one end of the string 98 is secured. When the spool 96 is rotated by the motor 82 in the first direction as described above, the string 98 winds up and around the barrel 124. The other end of the string 98 is secured to the carriage 30. The string 98 is guided through the handle 24 and the housing 12 by a plurality of pulleys 126. Thus, when the string 98 is wound up around the spool 96, the carriage is guided along the track 42 and pulled into the housing 12 away from the opening 14. When the spool 96 is disengaged from the second step gear 94, the spool 96 is free to rotate and the string 98 can be unwound therefrom which allows the carriage 30 to be moved toward the opening 14 along the track 42.

To load the liner L into the waste collection device 10, the door 50 and the carriage 30 are moved to appropriate positions if these components are not already in these positions. More specifically, with reference to FIG. 3, the door 50 is moved to its open position if it is not already in the open position. To move the door 50 to its open position from its closed position, a user pushes the knob 52 and slides it along the track 54 away from the opening 14. The knob 52 pulls the door 50 via the link 56 along the pair of tracks 58 and positions the door 50 in its open position. More specifically, the door 50 includes a set of four tabs or stubs 130 (See also FIG. 13) that move along the tracks 58 to guide movement of the door 50. The link 56 moves with the knob 52. Concerning the carriage 30, it is moved to its position adjacent the opening 14 (the position shown and the first position) if it is not already in this position. To move the carriage 30 to the position adjacent the opening 14 from any other position, the user grasps the carriage 30 and pulls it toward the opening 14. Provided the switch actuator 120 is not depressed, the string 98 unwinds from the spool 96 permitting the carriage 30 to be moved toward the opening 14.

Figure 2:
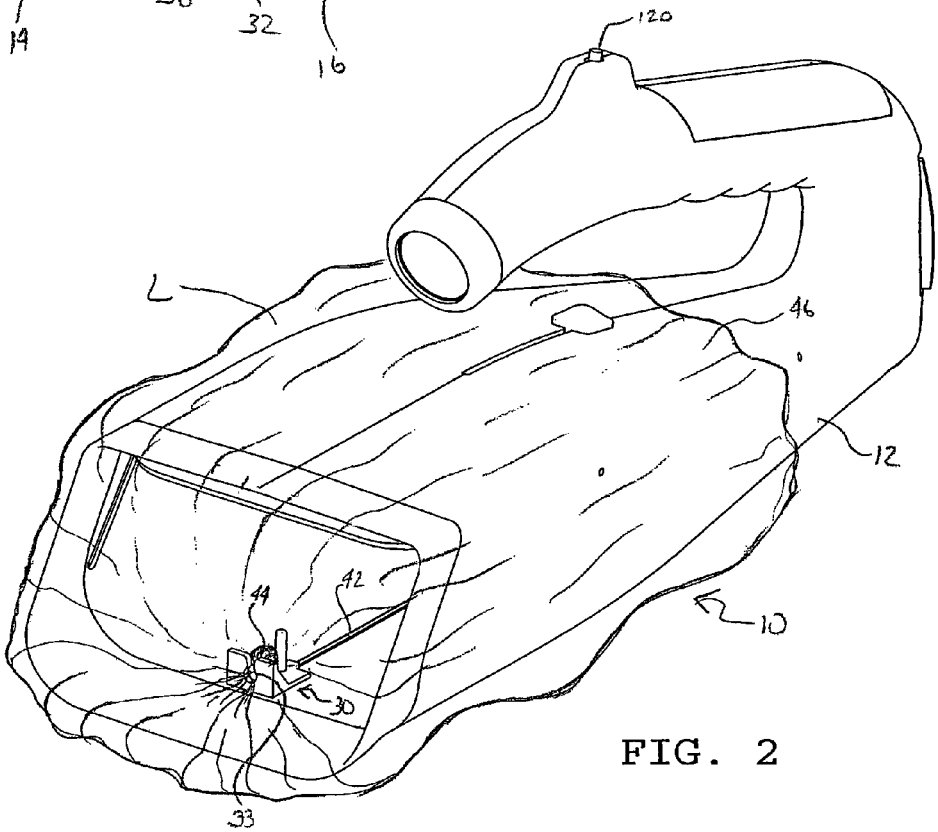
FIG. 2 is a perspective view of the waste collection device of FIG. 1 showing the balled end of the liner in the slot of the carriage and a second end of the liner folded around a portion of the housing.
Figure 4:
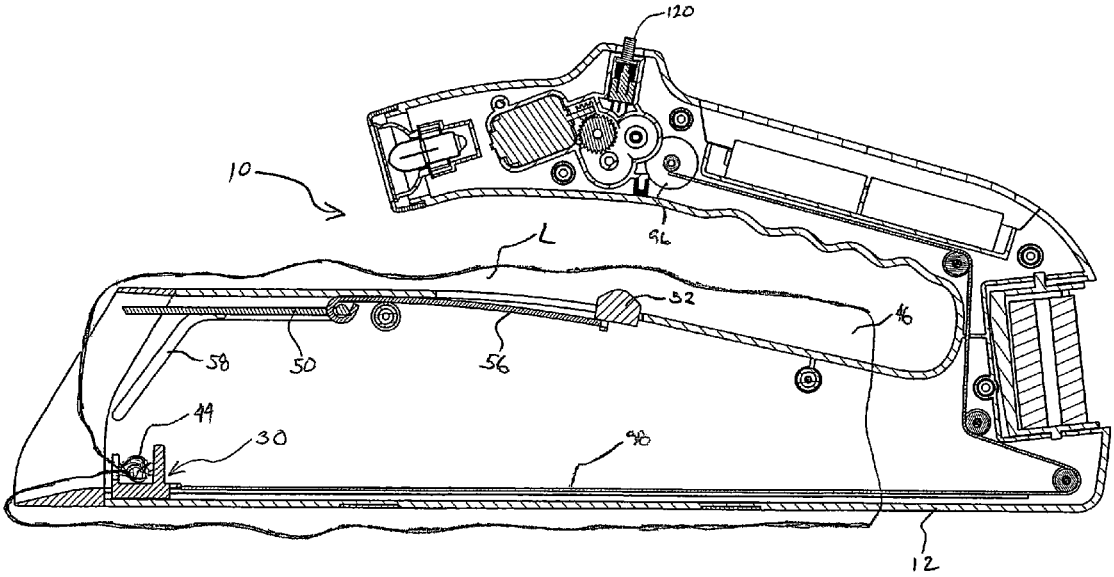
FIG. 4 is a cross-sectional view of the waste collection device of FIG. 3 showing the balled end of the liner in the slot of the carriage and the second end of the liner folded around the housing.

With the door 50 and carriage 30 in their appropriate positions, and with reference to FIGS. 1 and 3, the balled end 44 of the liner L is positioned on the carriage 30 on an interior side of the carriage wall 36, i.e., the side facing the interior of the housing 12, so that the area 48 of the liner L immediately forward of the balled end 44 is inserted into the slot 38. With reference to FIGS. 2 and 4, once the balled end 44 is secured to the carriage 30, the open end 46 of the liner L is folded back over the housing 12. This action is similar to the typical manner in which a conventional waste basket liner is folded over the rim of a conventional waste basket.

Figure 5:
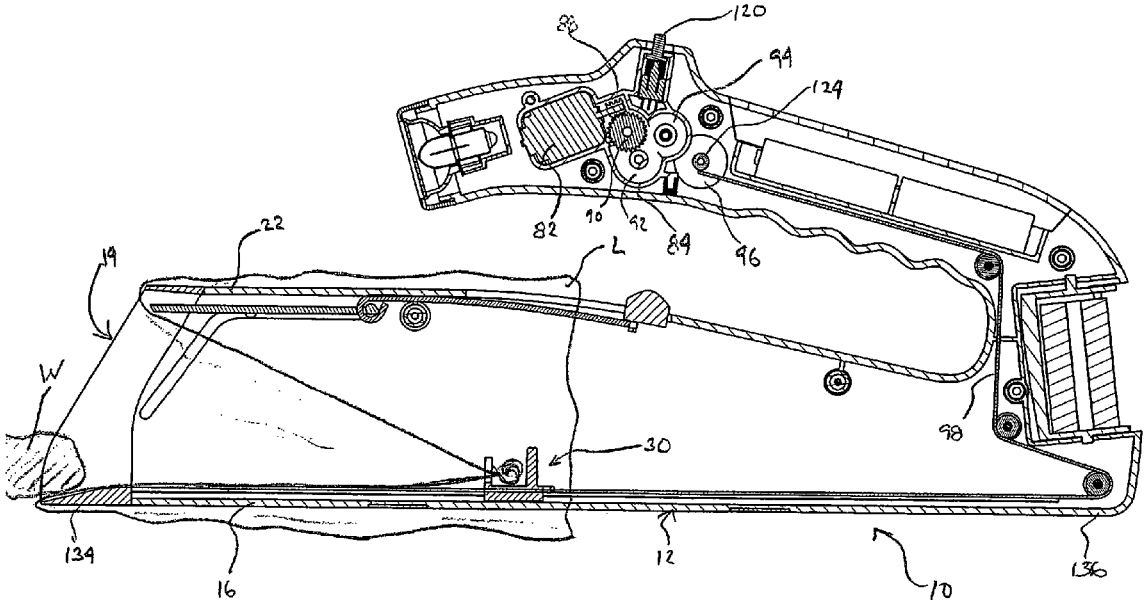
FIG. 5 is a cross-sectional view of the waste collection device of FIG. 4 showing the carriage moved to a first position spaced away from the opening and the device adjacent a piece of debris ready to be picked up.

Next, with reference to FIG. 5, the switch actuator 120 is depressed into its second position to move the carriage 30 until it is moved to a first inward position. As shown, the first inward position is a position located between the position adjacent the opening 14 (shown in FIGS. 14) and a second inward position (shown in FIG. 6). More specifically, with additional reference to FIG. 10, depression of the actuator 120 to the second position activates the motor 82 which turns the plurality of gears 88–94 and pivots the housing 84 such that the roller member 114 engages the spool 96. As a result of the rotation of the compound member 94 and its frictional engagement with the spool 96, the spool 96 rotates in the first direction wherein the string 98 is collected on the barrel 124 and the carriage 30 is pulled into the housing 12. Once the carriage 30 reaches its first inward position, the switch actuator 120 is released, i.e., it is no longer depressed. Due to the second spring 122, when the switch actuator 120 is no longer depressed, the motor 82 shuts off and, due to the first spring 116, the housing 84 pivots away and disengages from the spool 96. In the first inward position, the carriage 30 pulls the liner L partially into the housing 12 to form a pocket in the liner L for picking up debris or waste.

To pick up waste or debris, with specific reference to FIG. 5, the waste collection device 10 is angled slightly and positioned so that the opening 14 is adjacent a piece of debris or waste W desired to be picked up. More specifically, a lip portion 134 of the lower wall 16 is partially inserted between the waste W and the ground or surface supporting the waste W. The lip portion 134 could extend from the housing 12 a distance greater than an edge or end of the upper wall 22 opposite the lower wall 16, if desired. With the lip portion 134 partially inserted under the waste W, a portion of the waste W rests on the liner L folded over the lip portion 134. Then, with additional reference to FIG. 6, the actuator 120 is depressed to its second position for a sufficient amount of time to allow the carriage 30 to be pulled by the motor 82 to a second inward position that is adjacent a rear portion 136 of the housing 12 opposite the opening 14. At the same time, the housing 12 is manually moved forward toward the waste W.

Figure 6:
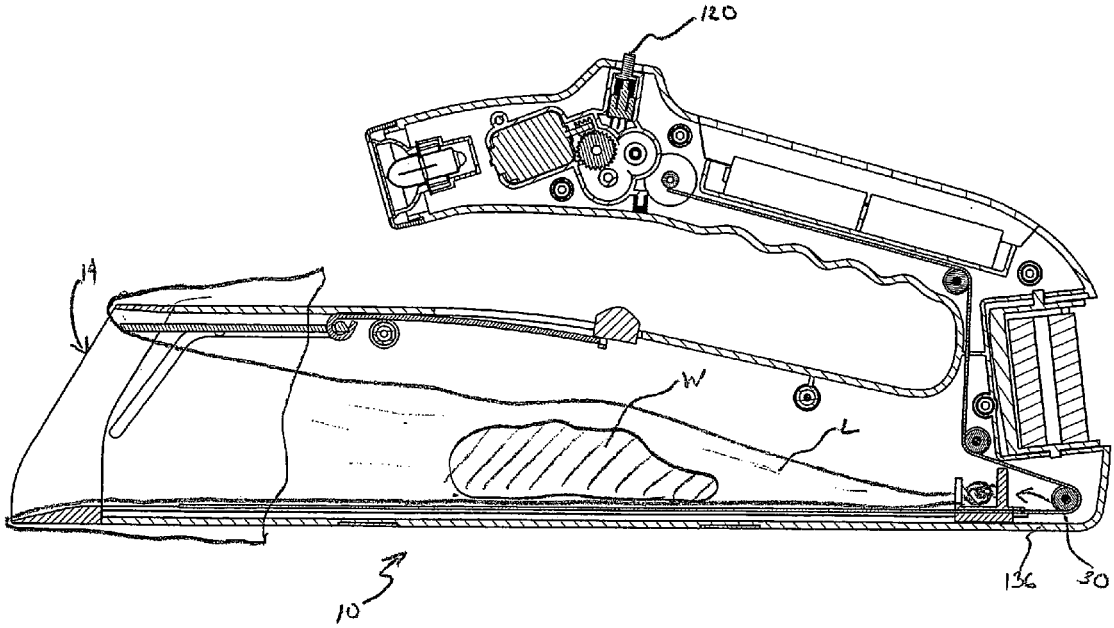
FIG. 6 is a cross-sectional view of the waste collection device of FIG. 5 showing the carriage moved to a second position spaced away from the opening and with the waste pulled into the housing.

As the carriage 30 moves from the first inward position shown in FIG. 5 to the second inward position shown in FIG. 6, the waste W is pulled into the device 10 on the liner L and the device 10 is manually moved toward or into the waste W to continue feeding the waste W to the device 10. More specifically, the static friction between the waste W and the liner L is greater than and overcomes the static friction between the waste W and the surface the waste W is resting upon and the relatively weak gravitational resistance acting on the waste W such that the waste W is pulled into the housing 12 as the liner L is pulled into the housing 12. The gravitational forces resisting pulling of the waste W into the housing, 12 are relatively weak because the device 10 is only slightly angled relative to the surface below the waste W. The length of the housing 12 and the distance that the carriage travels between its first inward position and its second inward position are generally sufficiently long enough to allow the waste W to be fully pulled into the housing 12.

Figure 7:
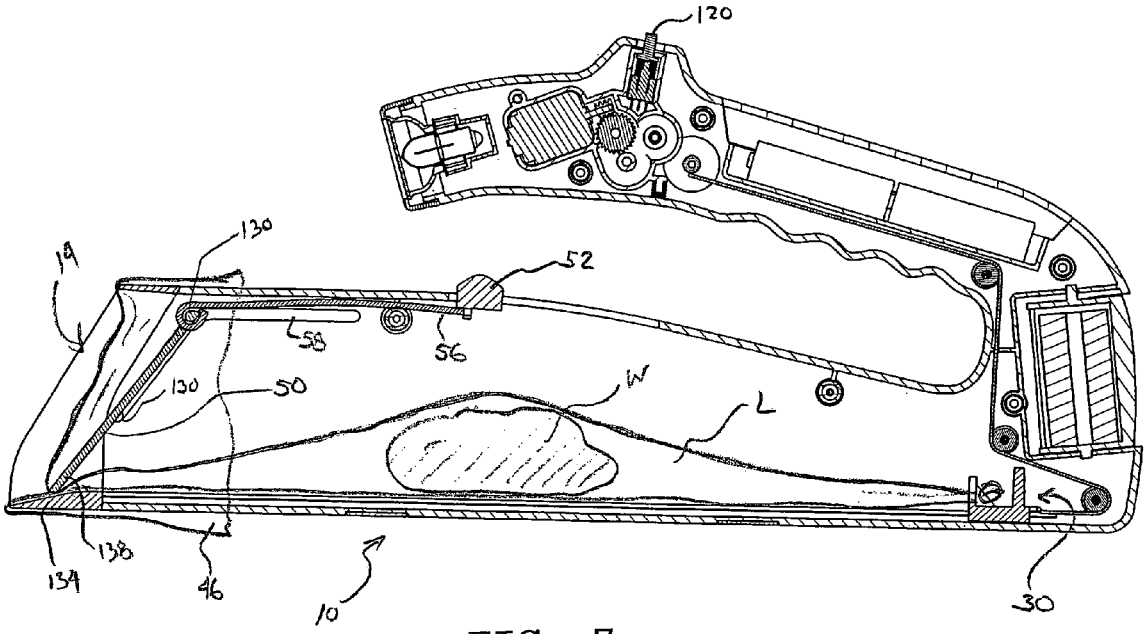
FIG. 7 is a cross-sectional view of the waste collection device of FIG. 6 showing a door of the device in a closed position covering the opening and pinching the liner.

With reference to FIG. 7, once the waste W is pulled into the device 10, the door 50 can be moved to its closed position. More specifically, the knob 52 is slidably moved from a first position corresponding to the open position of the door 50 (See FIG. 6) toward the opening 14 to a second position corresponding to the closed position of the door 50. As already described, the knob 52 is connected to the door 50 by the link 56. Thus, when the knob 52 is moved, the link 56 pushes the door 50 into the closed position as the stubs 130 of the door 50 follow the tracks 58. With specific reference to FIG. 7, as the door 50 moves to its closed position, an edge 138 of the door 50 pinches or closes the liner L together at or near the lip portion 134 thereby trapping any waste W already in the liner L. Because of the arrangement and positioning of the stubs 130 and the track 58, the door 50 is self-locking and prevented from accidentally pivoting open. Thus, opening of the door 50 requires movement of the-knob 52.

Figure 8:
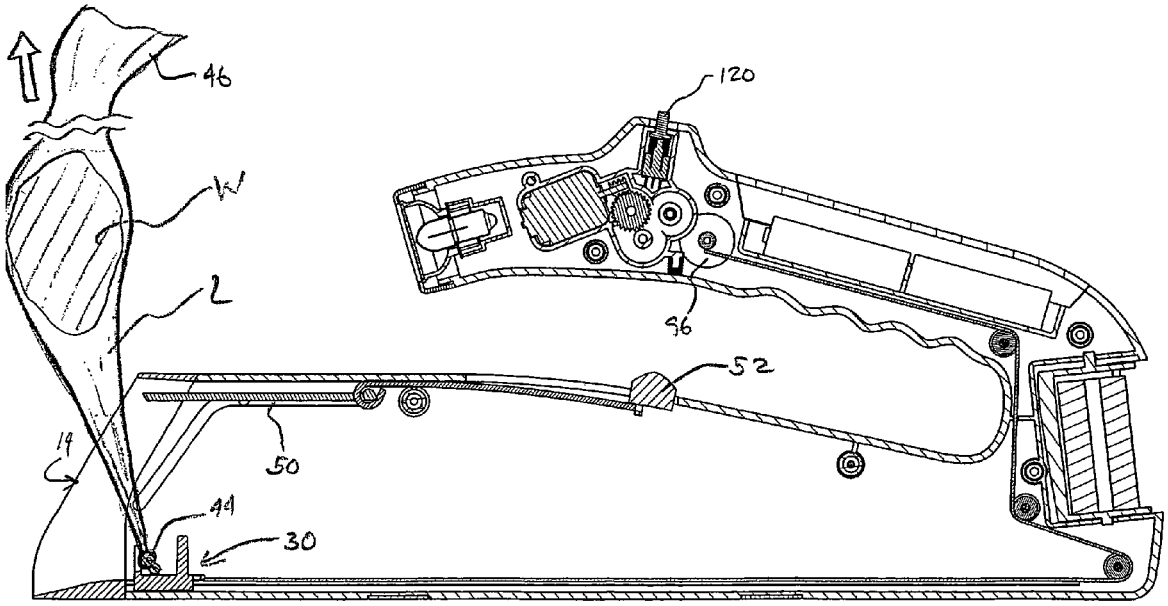
FIG. 8 is a cross-sectional view of the waste collection device of FIG. 7 showing the folded end of the liner removed from the device and held together to hold the piece of debris within the liner and with the carriage moved back adjacent the opening for disconnection of the balled end of the liner therefrom.

To remove the liner L with the waste W container therein, a user grasps the open end 46 of the liner L or any portion of the liner L between the open end 46 and the area of the liner being pinched by the door edge 138 and holds the open end 46 closed. It could also be permanently closed by a clamp (not shown) or via a known zip-lock type arrangement (not shown). Next, as already described in detail, the door 50 is moved from the closed position to the open position by sliding the knob 52 to its first position. With additional reference to FIG. 8 and the actuator 120 in its normal position, i.e., not depressed, the spool 96 is free to rotate which allows the carriage 30 to be pulled via the liner L to its position adjacent the opening 14. The liner L can then be lifted from the device 10 and the balled end 44 removed from the carriage 30. Thereafter, the liner L with the waste W therein can be discarded.

Figure 14:
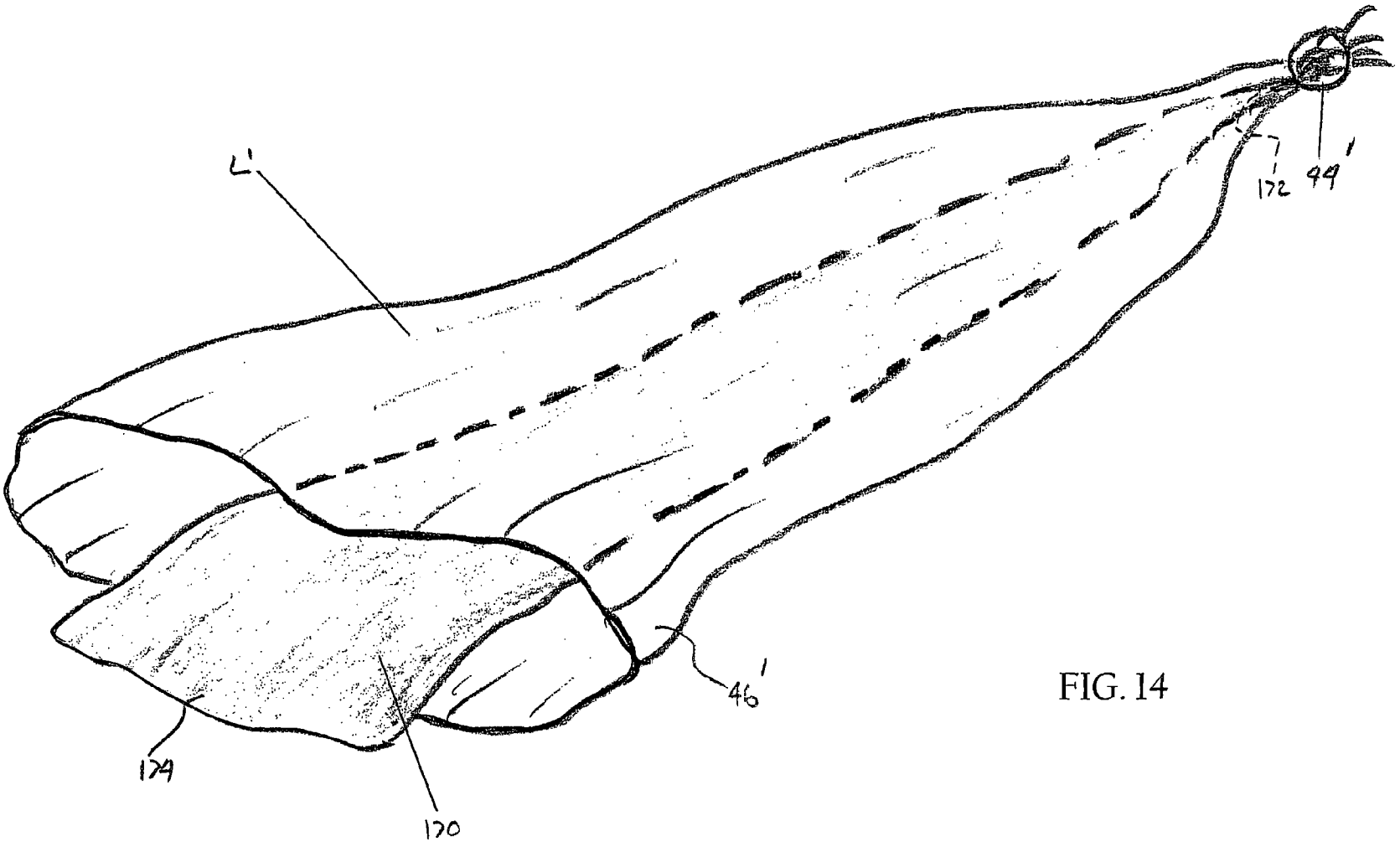
FIG. 14 is a perspective view of a second type of liner for use with the waste collection devices described herein.

FIG. 14 shows an alternate liner for use with a waste collection device according to another preferred embodiment of the present invention where like components of the liner are identified by like numerals with a primed suffix (') and new components of the liner are defined by new numerals. In many respects, the liner L' is like the liner L described above. The liner L' can be constructed of a material such as that used to form conventional trash bags. The liner L' has a closed or balled end 44' and an open end 46'. Unlike the liner L, the liner L' includes a sheet 170 for assisting in the removal of waste as will be described in more detail below. The sheet 170 has a first end 172 attached to or formed with the balled end 44' and a second end 174 can be freely extending therefrom to about or approximately the open end 46' of the liner L'. The sheet 170 can be formed of an absorbent material similar to a conventional absorbent paper towel.

Figure 15:
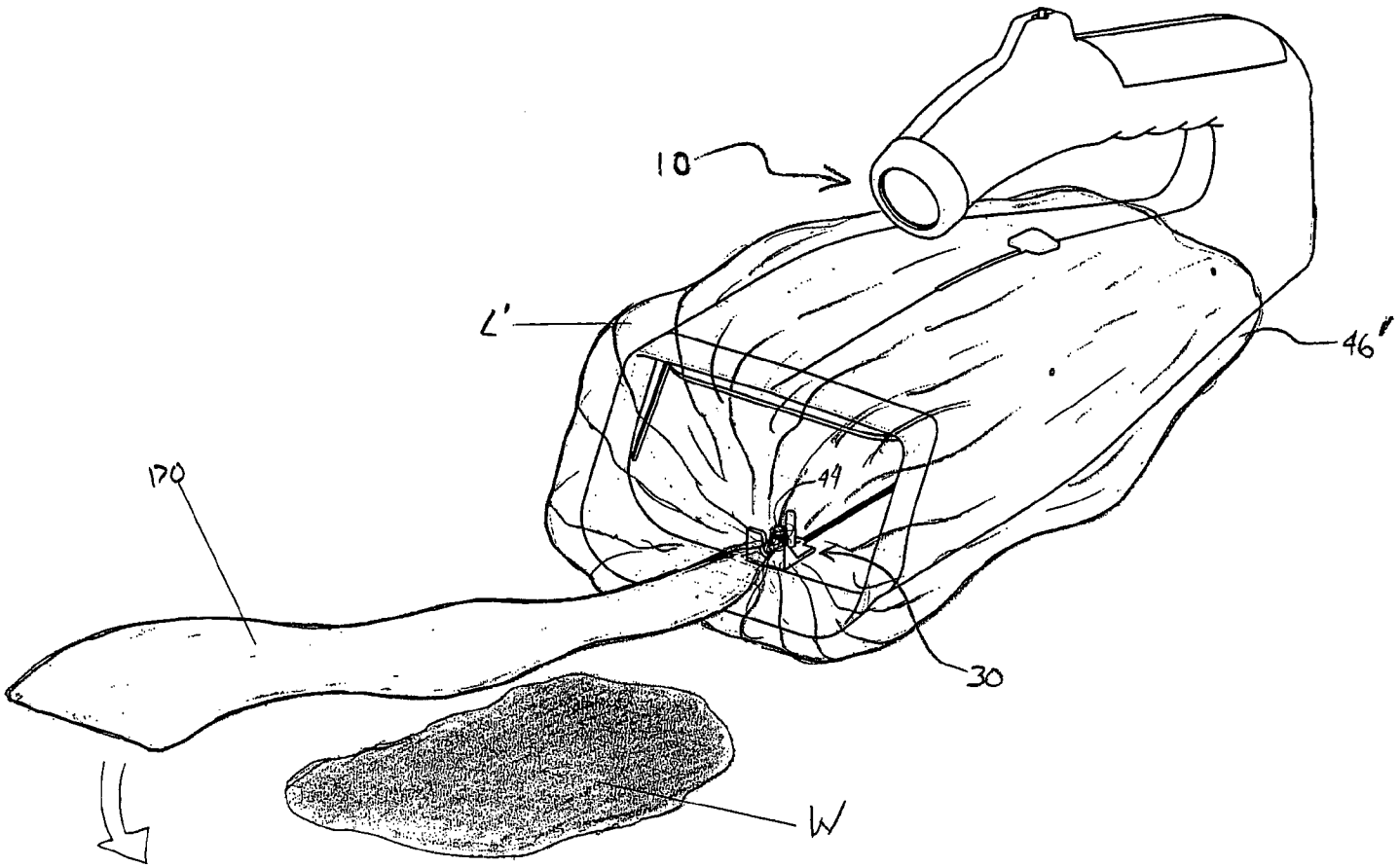
FIG. 15 is a perspective view of the liner of FIG. 14 mounted to the waste collection device of FIG. 1 with the sheet extending therefrom over some at least partially liquid waste.
Figure 16:
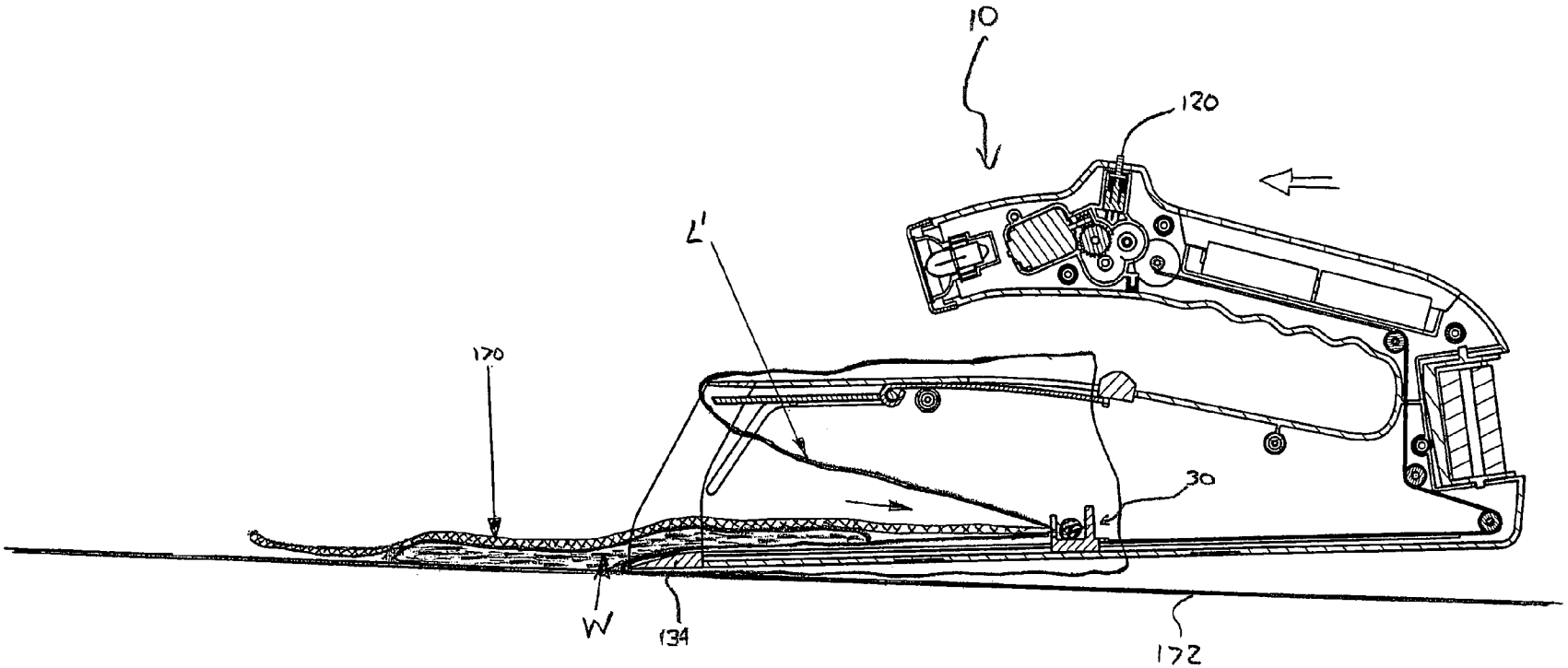
FIG. 16 is a cross-sectional view of the waste collection device of FIG. 15 shown after a portion of the waste has been drawn into an opening of the device.

With reference to FIG. 15, the liner L' is generally installed in the device 10 as described in reference to the liner L. More specifically, the balled end 44' is connected or secured to a carriage 30 and the open end 46' is folded back over the device 10. The sheet 170 is allowed to freely extend forward of the device 10 as shown. To remove waste W from a surface 172, with additional reference to FIG. 16, the device 10 is generally used as described above with reference to the liner L except that the sheet 170 of the liner L' is now used to facilitate removal of the waste W from the surface 172. More specifically, the sheet 70 is positioned directly over the waste W to be removed.

Next, the actuator 120 is depressed to move the carriage 30 from the position adjacent the opening to the first inward position. Simultaneously or while the carriage 30 is moving, the lip portion 134 is wedged between a portion of the waste W and the surface 172 supporting the waste W and the sheet 170 is used to physically force at least a portion of the waste W into the device 10. The static friction between the portion of waste W and the liner L' combined with the physical force of the sheet 170 is greater than the static friction between the waste W and the surface 172 and the relatively small gravitational force acting on the waste W as a result of the slight tilting or angling of the device 10. Thus, the waste W is pulled by the liner L' into the device 10, and trapped between the liner L' and the sheet 170, as the liner L' is pulled into the device 10.

At this point, the actuator 120 can continue to be depressed as the carriage 30 moves toward its second inward position and the waste W is pulled completely into the device 10. The sheet 170 provides the additional benefit of absorbing any or some of any liquefied portion of the waste W that could otherwise remain after removal of the waste W. While the sheet 170 is shown as being attached only adjacent its rear end to the liner L', it should be appreciated that the entire sheet could be secured to the liner if desired. In that case, the waste would be located atop the sheet 170 in the device. Alternately, the liner L' could be formed with an absorbent material such as the sheet 170 along its entire interior for better absorption of waste W or along only a lower portion of the liner L' so that only a folded over portion of liner L' has an absorbent sheet.

Figure 17:
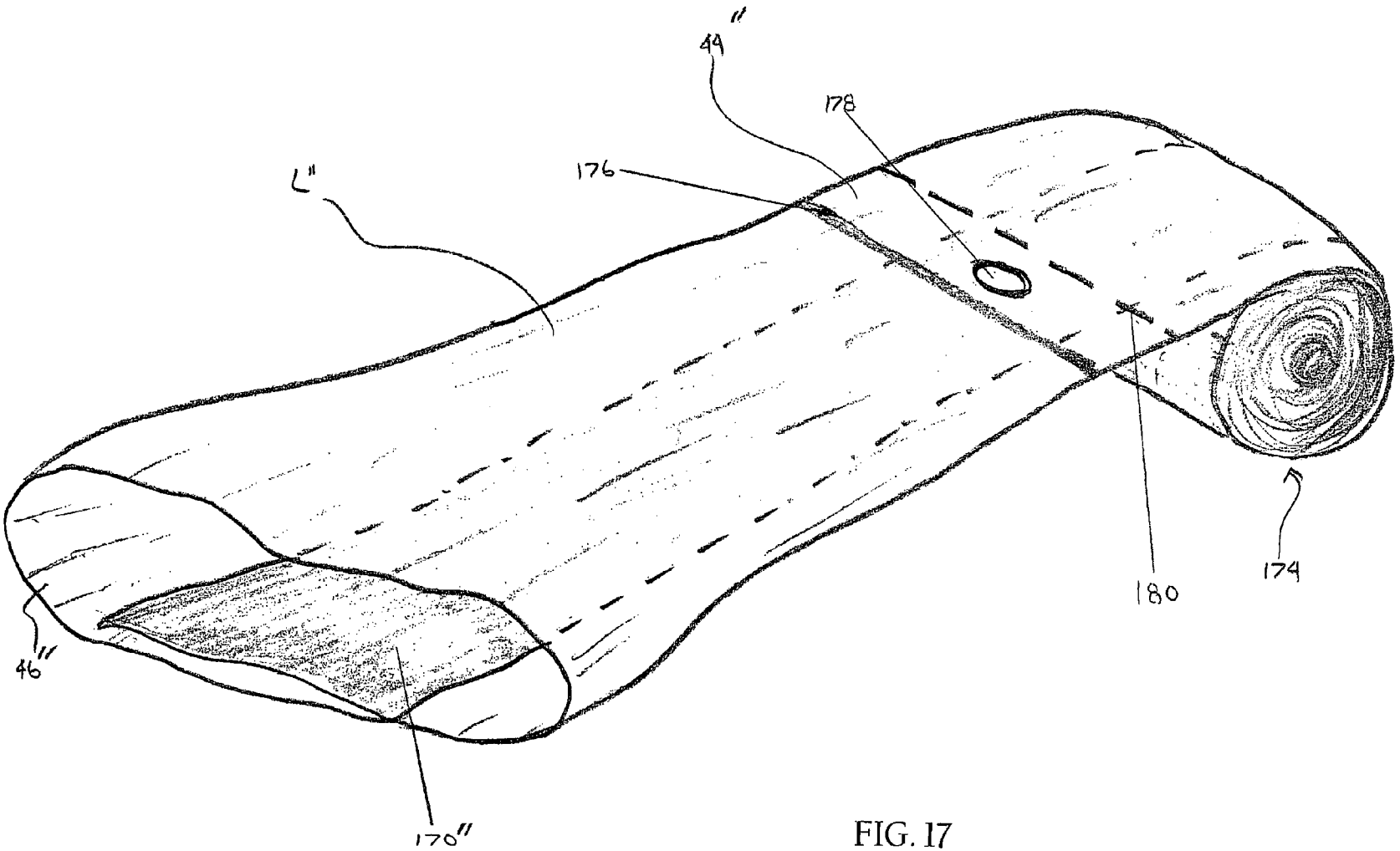
FIG. 17 is a cross-sectional view of a roll of liners adaptable for use with any of the waste collection device described herein.

FIG. 17 shows another alternate liner for use with a waste collection device according to yet another preferred embodiment of the present invention, wherein like components are identified by like numerals with a double primed suffix (") and new components are defined by new numerals. A liner L" may be formed as one of a plurality of rolled liners 174. Each liner L" includes a closed end 44" and an open end 46". Additionally, each liner L" optionally includes a sheet 170" as described above or in any of the alternate configurations discussed above. The liner L" is closed adjacent the closed end 44" by fusing together a portion of the material used to form the liner L" along a seam 176. Adjacent the seam 176, an opening 178 is provided for fastening the liner L" to a carriage of the waste collection device. Specifically, the opening 178 is receivable on a post (see post 34 in FIG. 1) of the carriage. The liner L" includes a perforation line 180 for separating the liner L" from the roll of liners 174. In most other respects, the liner L" is used as described above in reference to the liners L and L'.

Figure 18:
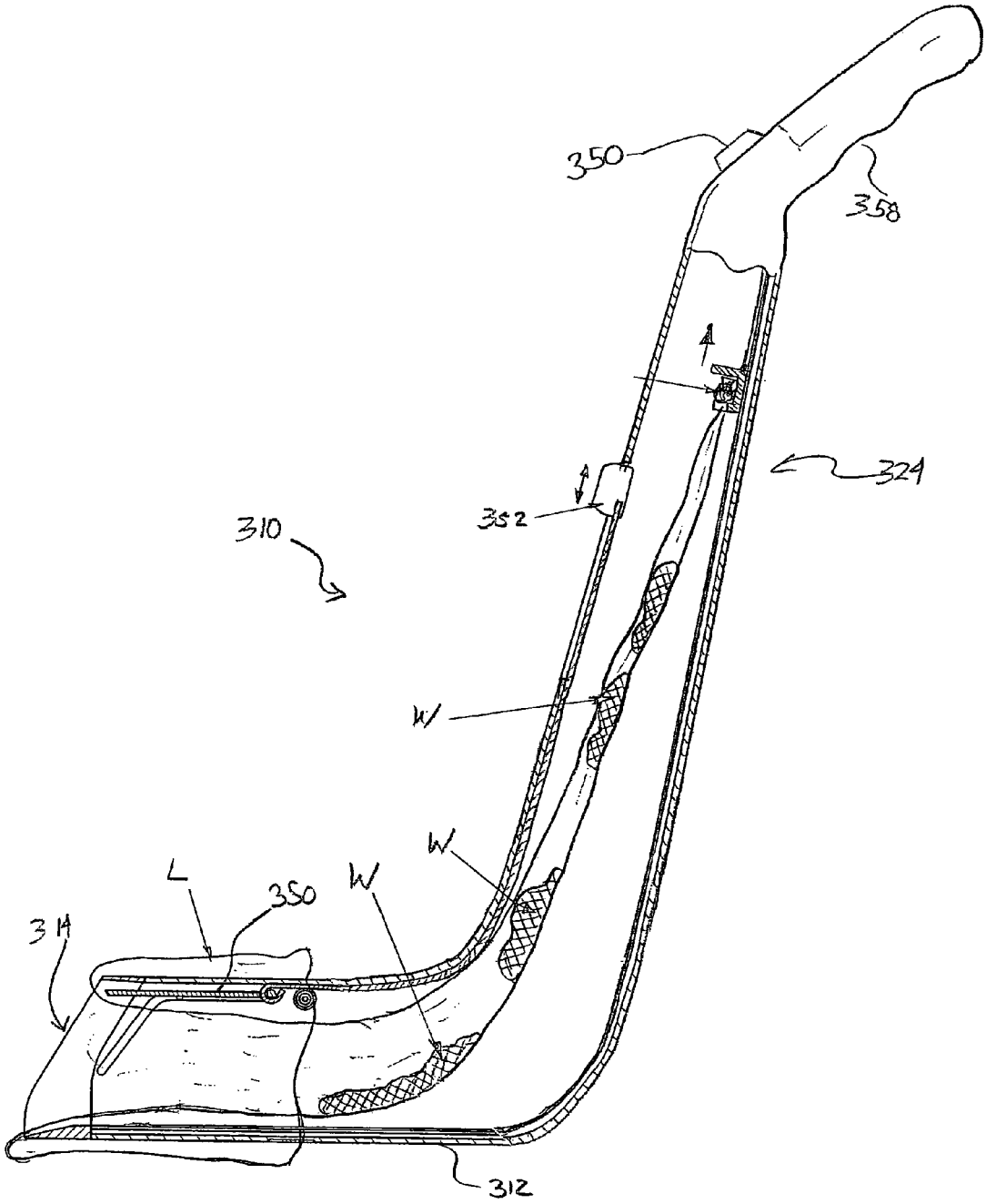
FIG. 18 is a perspective view of a waste collection device having an upright handle in accordance with another embodiment of the present invention.

With reference to FIG. 18, a waste collection device 310 is shown in accordance with another preferred embodiment of the present invention. The device 310 includes an elongated, upright handle 324 that enables a user to operate the device 310 without bending over or crouching down, i.e., the user can pick up debris or waste W while standing. As a result of the additional volume created in the device 310 due to the elongated handle 324, the liner L used with the device 310 can be elongated thereby enabling the device 310 and liner L to pick up and store multiple waste piles or pieces W. For ease of use, a knob 352 of the device 310 is positioned a greater distance from an opening 314 and relatively close to a gripping portion 358 so that a user is not required to reach down or bend over to operate the knob 352. In most other respects, the device 310 is constructed and used as described above in reference to the device 10.

Figure 19:
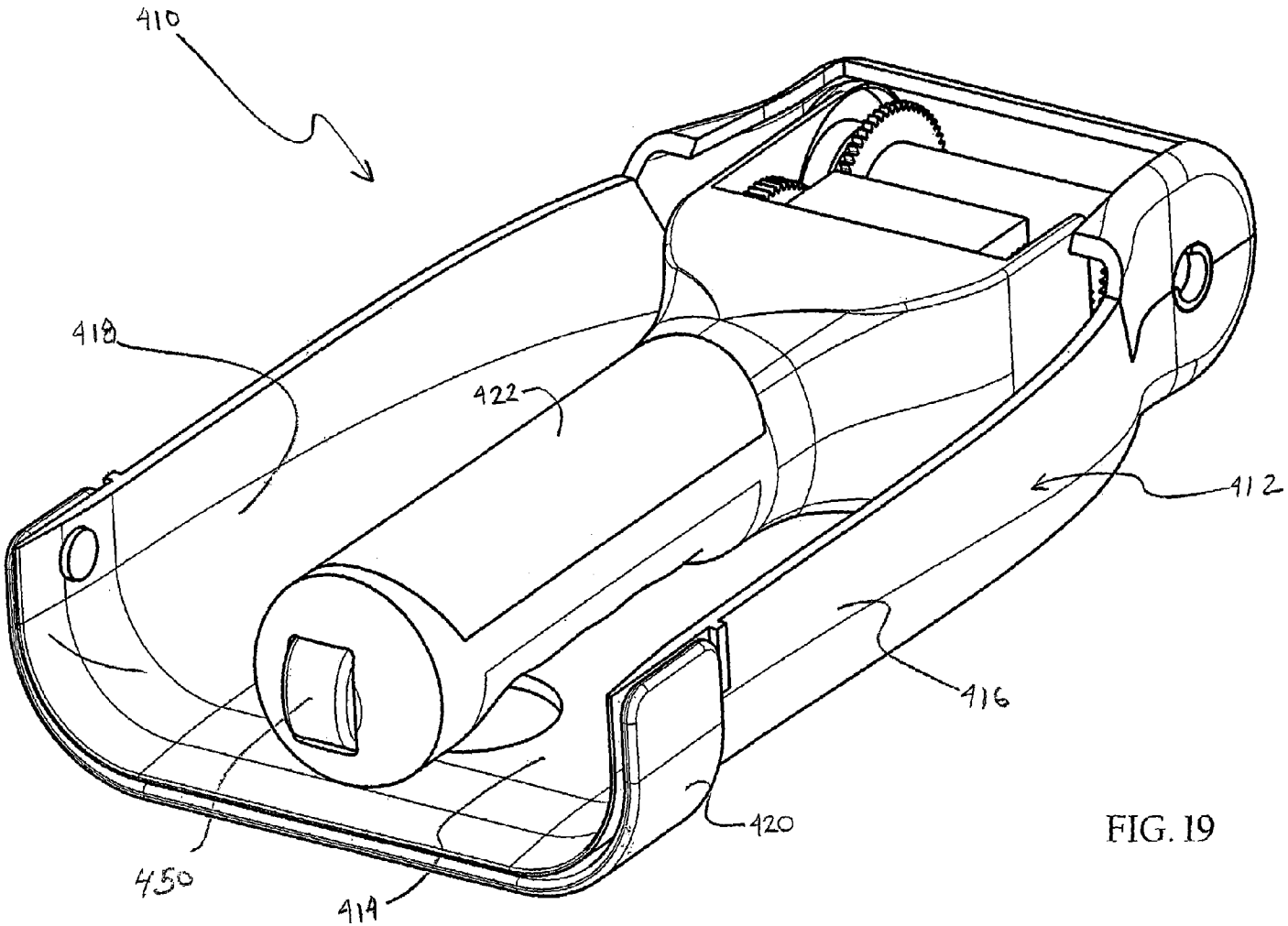
FIG. 19 is a front perspective view of a fold-up waste collection device according to yet another embodiment of the present invention showing the device in a folded-up position.

FIG. 19 shows a fold-up waste collection device 410 according to yet another preferred embodiment of the present invention. The device 410 is shown in a folded-up position wherein the device is relatively compact for easy storage thereof. The device 410 can also include a body having a housing including a U-shaped or channel-shaped base portion 412 formed of a substantially flat lower wall 414 and a pair of spaced apart side walls 416,418 extending upward from the lower wall 414. The body of the device 410 also includes a U-shaped opening frame 420 pivotally mounted to one end of the U-shaped base portion 412 and a handle 422 pivotally connected to an opposite end of the base portion 412. The handle 422 is folded against the lower wall 414 and into the base portion 412 in the folded-up position for compact storage.

With additional reference to FIG. 20, the device 410 is shown in an unfolded position wherein the device is able to remove waste as will be described in more detail below. In the unfolded position, the handle 422 is pivoted relative to the base portion 412 so that the handle 422 is angled in relation to a plane of the body which allows the handle 422 to be grasped by a user. For example, the handle can be oriented normal to the plane of the lower wall 414. Additionally, the opening frame 420 is moved from a closed position (FIG. 1) wherein the frame 420 pivots or nests around the U-shaped base portion 412 to an open position wherein the frame 420 and the U-shaped base portion 412 together define a rim or opening 424. When the frame 420 is in the open position and the opening 424 is defined, liner L can be secured to the device 410. However, the device can also operate without the frame 420.

Figure 21:
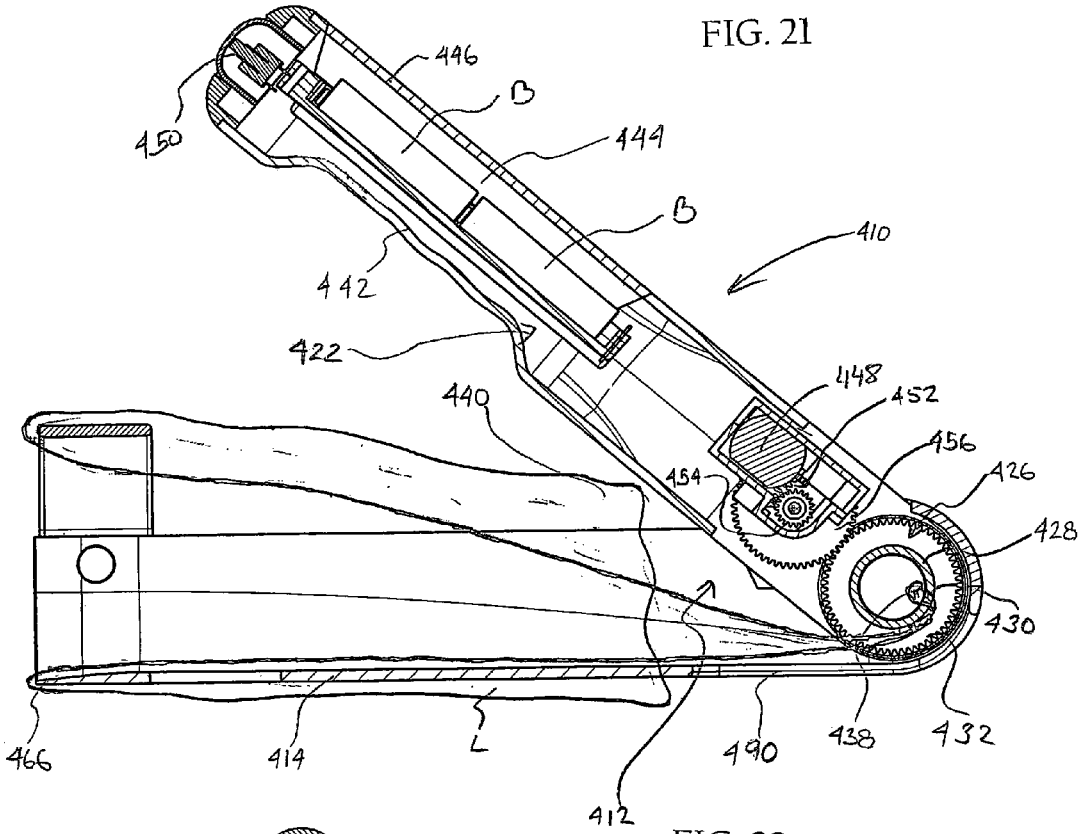
FIG. 21 is a cross-sectional view of the waste collection device of FIG. 19 showing a closed end of the liner secured to a spool.

More particularly, referring now to FIG. 21, the device 410 further includes a pulling mechanism including a spool 426 rotatably connected to the body. The spool 426 is adapted to be removably connected to the liner L to selectively pull the liner L into the device 410 for purposes of picking up waste or debris as will be described in more detail below. The spool 426 includes a means for releasably connecting the liner L thereto, a barrel 428 for receiving the liner L as it is wound about the spool 426 and a means for powered rotation of the spool. With additional reference to FIG. 28, in the illustrated embodiment, the means for releasably connecting the liner L to the spool 426 is a bag attachment slot 430 defined in the barrel 428. In alternate configurations, the means for releasably connecting the liner L to the spool 426 could be a clamp, a raised flange having a slot, etc. The means for powered rotation is a pair of spool gears 432 (See FIGS. 25–29) connected to the barrel 428. In alternate configurations, the means for powered rotation could be a cylindrical surface adapted for frictional engagement by a power source, a sprocket adapted to be chain driven, etc.

Figure 22:
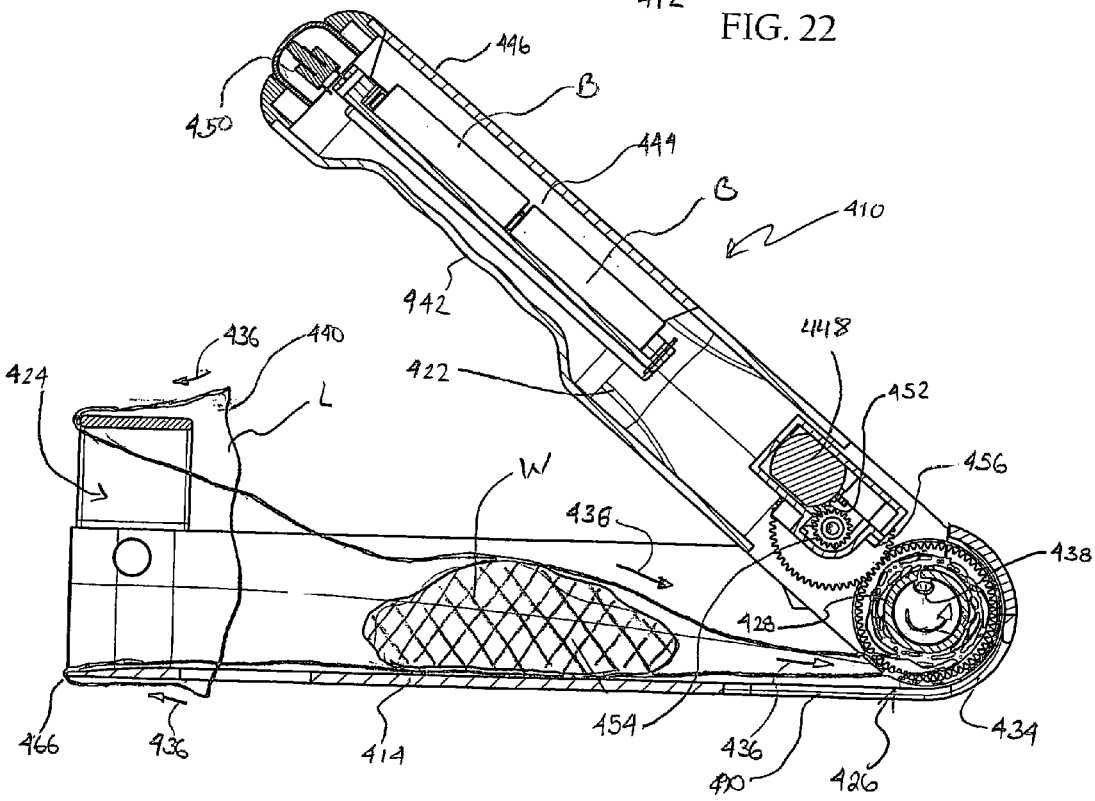
FIG. 22 is a cross-sectional view of the waste collection device of FIG. 21 showing the closed end of the liner partially wound on the spool after some waste has been pulled into the device.

With reference to FIG. 22, the spool 426 is shown with the liner L partially wound about the barrel 428. Arrow 434 shows a first direction in which the spool 426 can be rotated to affect a winding of the liner L about the barrel 428. Arrows 436 show the direction in which the liner L is pulled into the opening 424 and toward the spool 426. The pulling of the liner L toward the spool 426 can be used to remove waste W from a surface or the ground (not shown) and pull said waste toward the spool 426 as will be described in more detail below.

Figure 20A:
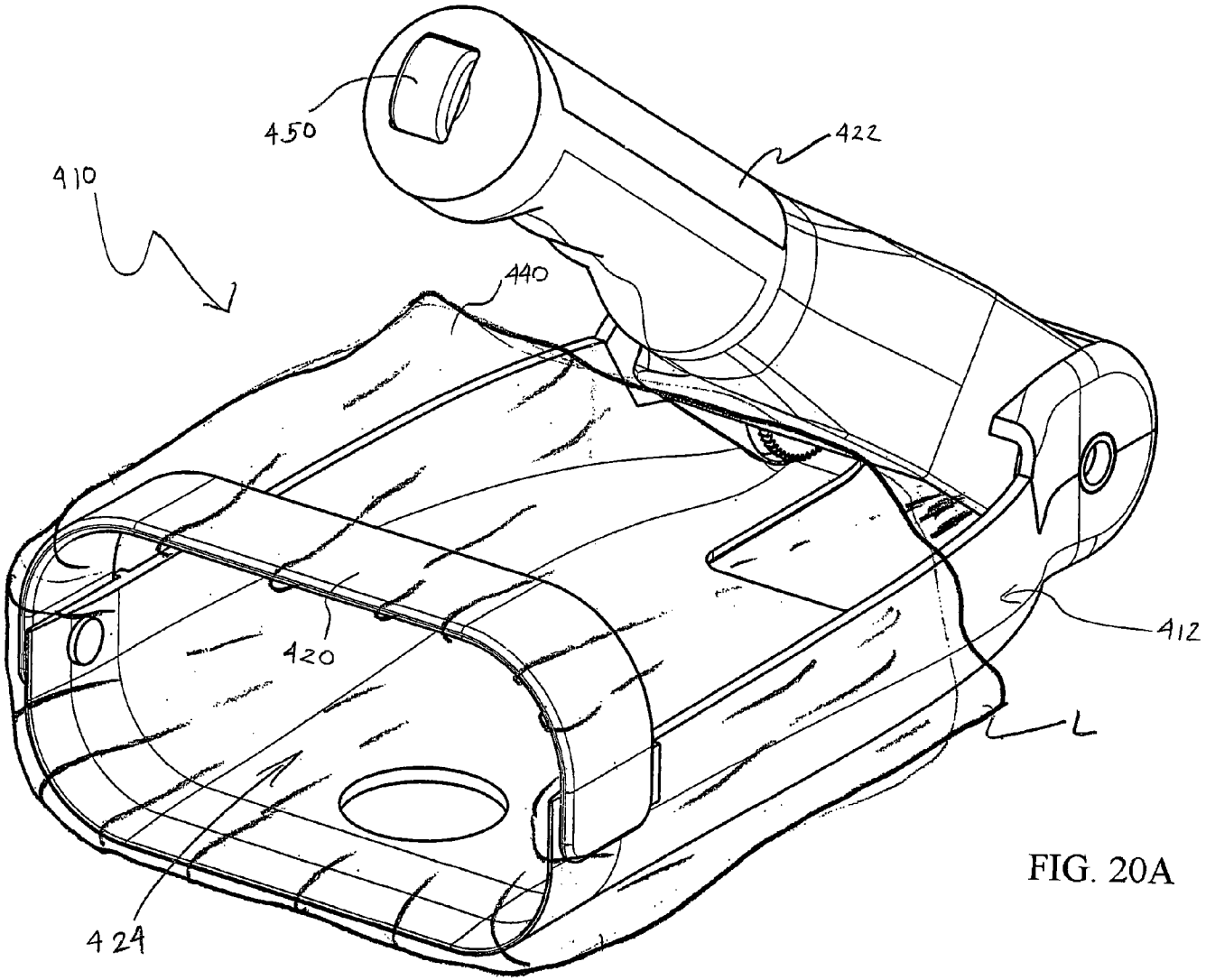
FIG. 20A is a perspective view of the waste collection device of FIG. 19 shown in an unfolded position and having a liner mounted to the device.
Figure 20B:
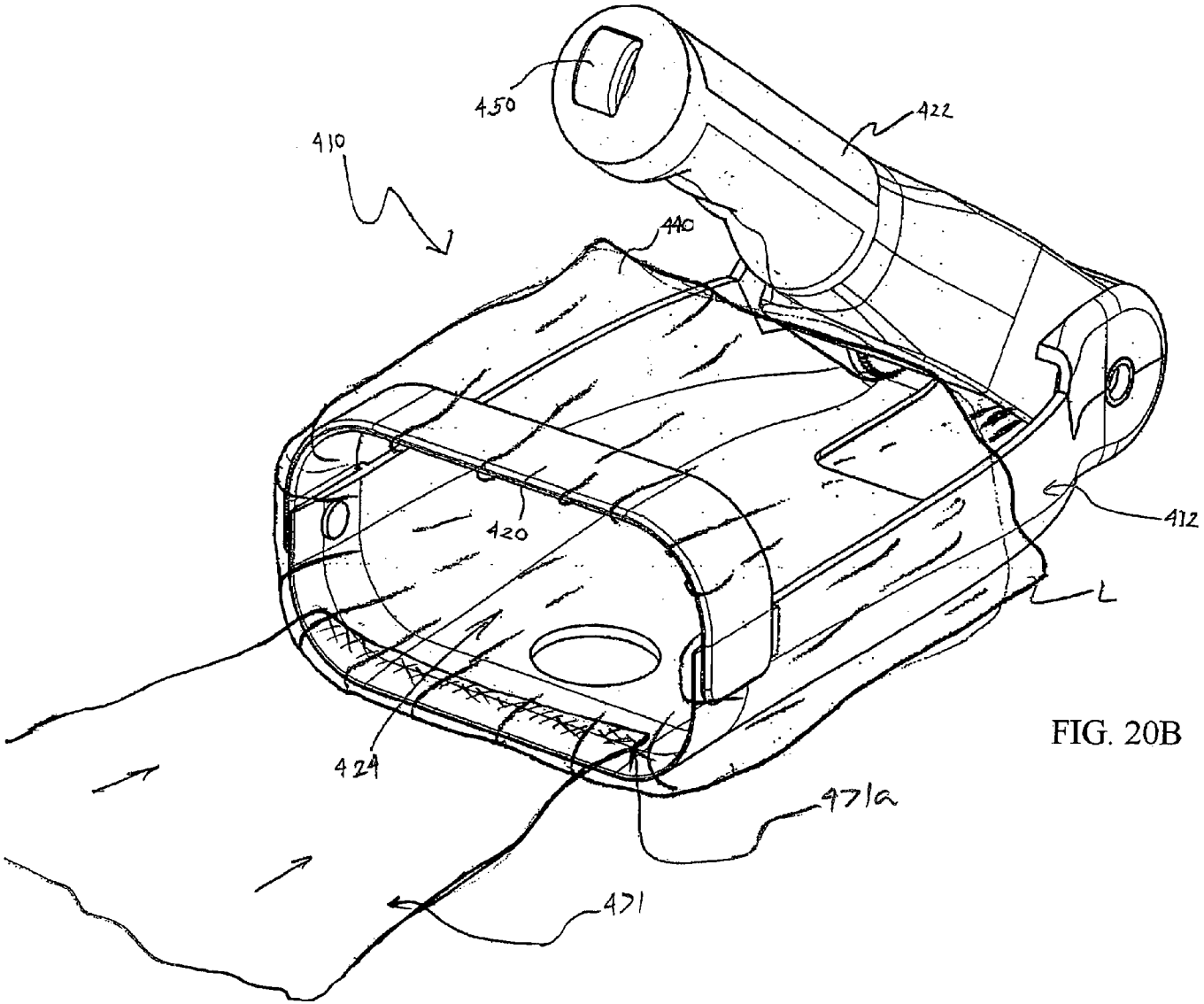
FIG. 20B is a perspective view of the waste collection device of FIG. 20A showing an optional sheet having an adhesive portion for attachment to the liner.

With reference to FIGS. 20–22, the liner L is generally a bag-like container having a closed end 438 and an open end 440. The closed end 438 can be a balled-together portion of the liner L. This allows the liner L to be formed of a tubular, flexible material similar to a conventional trash bag. To make the liner L, one end of the tubular, flexible material is balled together to form the closed end 438 and the other end 440 remains open so that the liner L can receive waste or debris therein. As shown in FIG. 21, the balled end 438 of the liner L is receivable in the slot 430 of the spool 426. The balled end 438 can easily be inserted and removed from the slot 430 when pushed or pulled in a direction generally perpendicular to the slot 430. However, when the spool 426 is rotated, the balled end 438 generally prevents the liner L from pulling apart from the spool 426. As a result, rotation of the spool 426 in the first direction causes the liner L to be pulled into the opening 424 and wound on the spool 426 and rotation of the spool 426 in a second, reverse direction will cause a wound liner L to be unwound from the spool 426.

In addition to its ability to pivot about the body 412, the handle 422 includes several other functional features. More specifically, the handle 422 includes a contoured grip portion 442 formed on an underside thereof so a user is better able to hold and operate the device 410. A battery storage compartment 444 is optionally formed in a middle portion of the handle 422 adjacent the gripping portion 442. The battery storage compartment 444 can be configured to operatively receive one or more batteries B such as conventional M alkaline batteries, or the like. The battery compartment 444 can be accessible through a cover or door 446.

The handle 422 further includes a driving mechanism including a motor 448, such as a conventional battery-powered electric motor, for providing powered rotation to the spool 426. The motor 448 can be selectively electrically connected to the batteries B for providing power thereto by actuation of a switch 450 located at a distal-end of the handle 422. Thus, while the switch 450 is depressed, power is allowed to flow from the batteries B to the motor 448 and, when the driving mechanism is connected to the spool 426 to rotate the spool, the liner L can be wound onto the spool 426 to thereby pull the liner L into the opening 424. When the switch 450 is released, power from the batteries is interrupted and prevented from reaching the motor 448.

The driving mechanism further includes a means for selectively connecting output of the motor 448 to the spool 426 so that the spool is rotated in a first direction when the motor 448 is actuated. More particularly, the motor 448 is selectively mechanically connected to the spool 426 for powering rotation thereof. When mechanically connected, the motor drives a worm gear 452. The worm gear 452 has a tooth or threads that are engaged with a small gear 454. The small gear 454 shares an axle with a pair of large drive gears 456 (See FIGS. 25–27). Thus, when the small gear 454 is rotated by the worm gear 452, the large gears 456 rotate. As will be described in more detail below, the spool gears 432 are selectively movable between an engaged position, wherein each of the spool gears 432 are respectively engaged with each of the large gears 456, and a disengaged position wherein the spool gears 432 are disengaged from the large gears 456.

Figure 25:
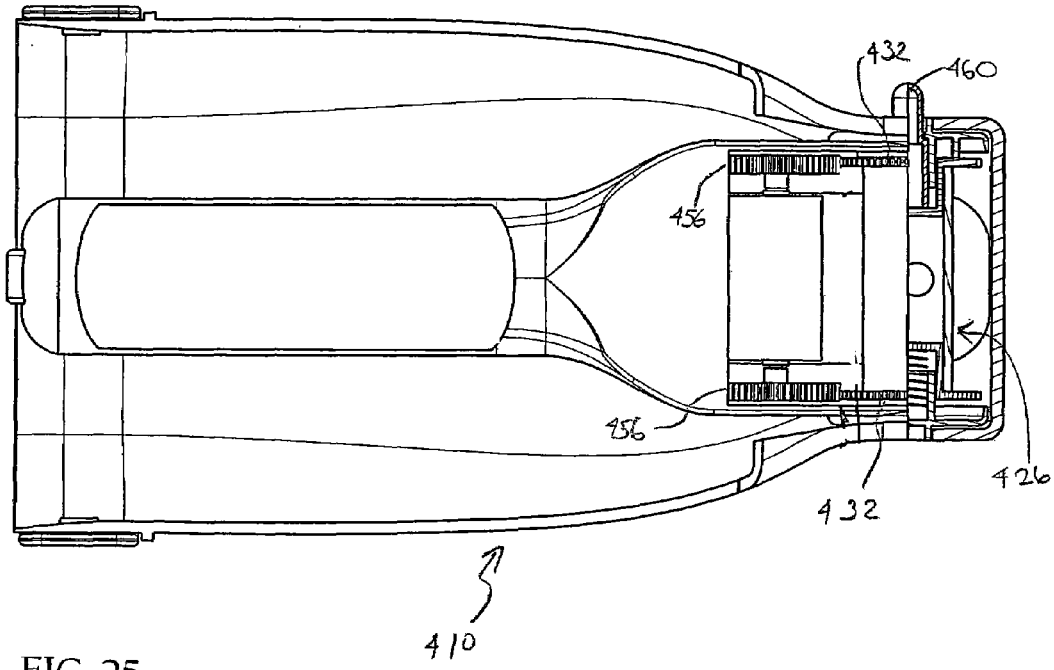
FIG. 25 is a top plan view of the waste collection device of FIG. 19 showing a set of drive gears engaged with a set of spool gears for rotating the spool.
Figure 26:
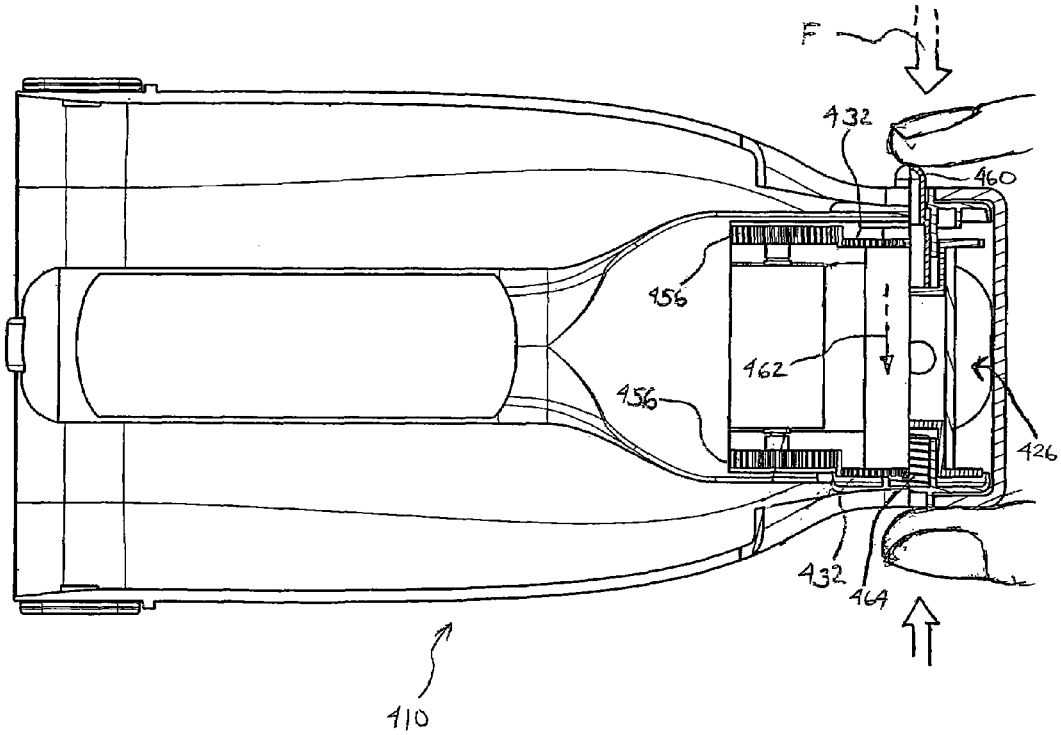
FIG. 26 is a top plan view of the waste collection device of FIG. 19 showing a user in the act of disengaging the spool gears from the drive gears.
Figure 27:
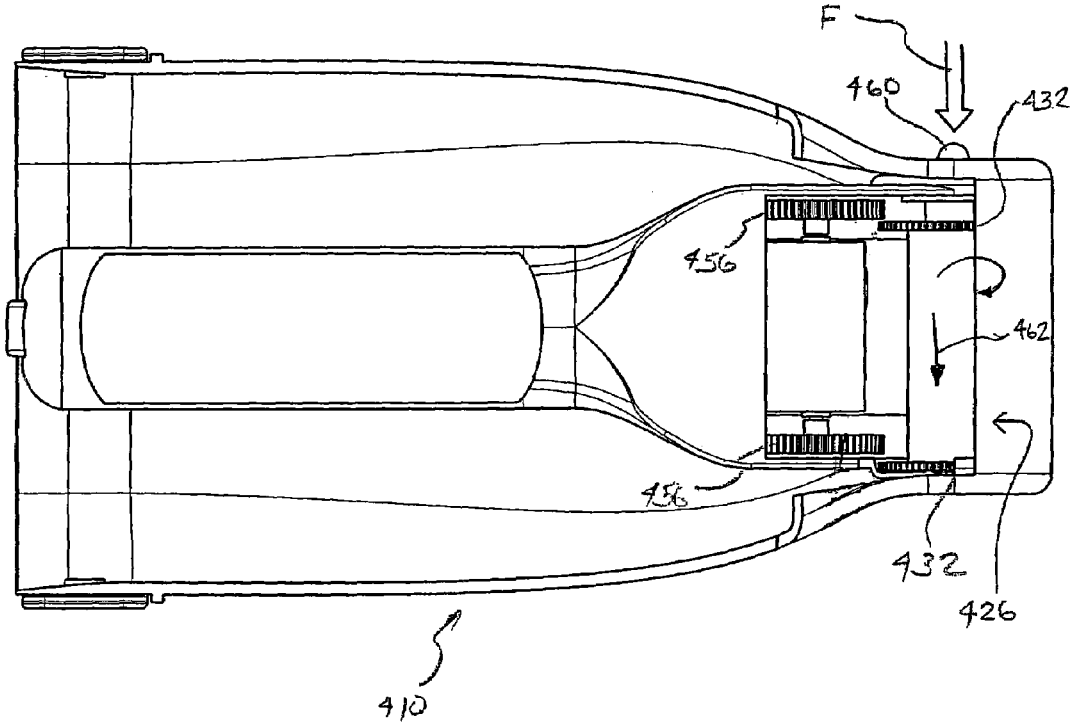
FIG. 27 is a top plan view of the waste collection device of FIG. 19 showing the spool gears disengaged from the drive gears.
Figure 28:
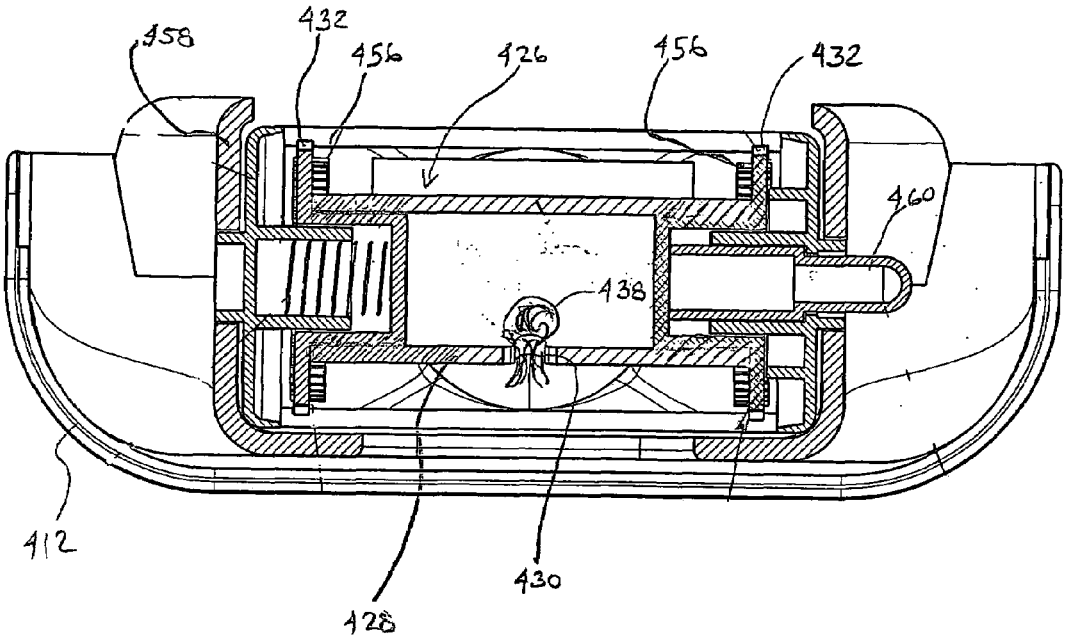
FIG. 28 is an enlarged partial cross-sectional view of a portion of the waste collection device of FIG. 19 showing the spool rotatably mounted in the device and engaged with the drive gears.

When the spool gears 432 are in their engaged position, rotation of the large gears 456 causes the spool 426 to rotate in the first direction via the spool gears 456. This, in turn, causes the liner L, when connected to the spool 426, to rotate or be wound about the barrel 428 of the spool 426 and be pulled into the opening 424. Winding of the liner L about the spool 426 is used to remove waste W from the surface or ground being cleaned, as will be described below. With reference to FIGS. 25 and 28, the spool 426 is shown in its engaged position, i.e., the spool gears 432 are engaged with the large gears 456. As shown, the spool 426 is rotatably mounted within a housing 458 and the housing is fixedly mounted to the body 412.

Figure 29:
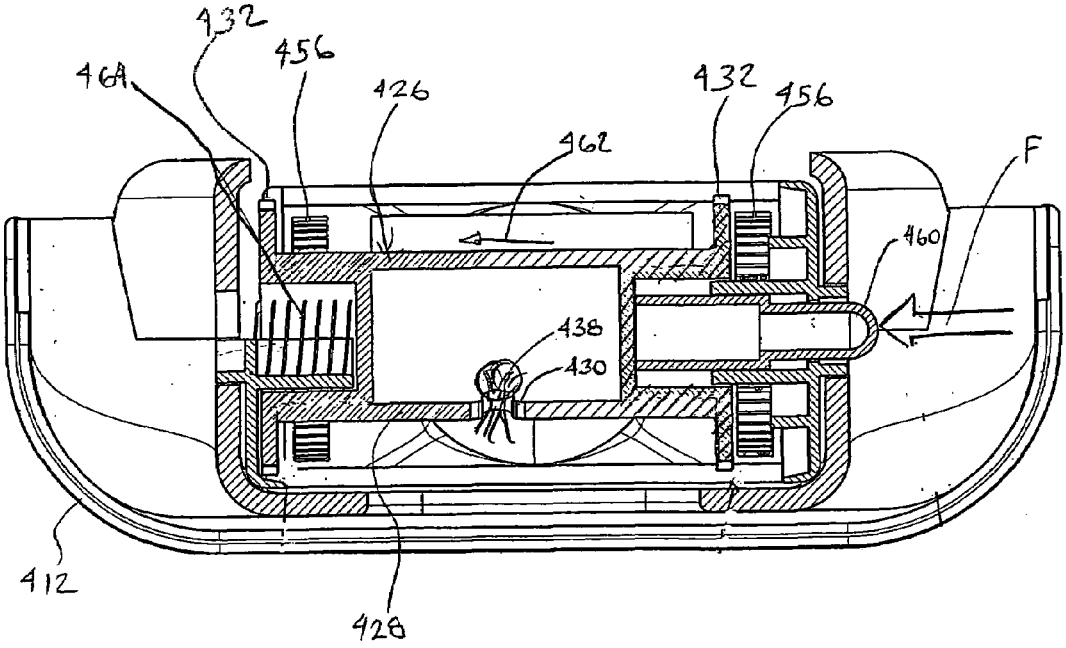
FIG. 29 is an enlarged partial cross-sectional view of a portion of the waste collection device of FIG. 19 showing the spool disengaged from the drive gears.

With additional reference to FIGS. 28–29, the means for selectively connecting output of the motor 448 to the spool 426 includes a means for disengaging the spool gears 432 from the gears 456 to allow manual rotation of the spool 426 in a second, opposite direction. The means for disengaging the spool gears 432 includes a disengaging knob 460 for moving the spool 426 from the engaged position to the disengaged position wherein the spool gears 432 are disengaged from the large gears 456. More particularly, when a force F is applied to the knob 460, the spool 426 is moved in the direction of arrow 462 thereby moving from the engaged to the disengaged position against the force of a biasing means such as a spring 464. Thus, the force F should be large enough to overcome the resistance created by the spring 464. When the force F is no longer applied, the spring 464 urges the spool 426 back to its normal, engaged position.

To load the liner L into the waste collection device 410, the handle 422 and the opening frame 420 are moved to appropriate positions (from their positions shown in FIG. 19) if these components are not already in their appropriate positions. More particularly, the handle 422 is moved to its unfolded position shown in FIG. 20 and, likewise, the opening frame 420 is moved to its open position shown in FIG. 20. With the handle 422 and frame 420 in their appropriate positions for loading the liner L, and with reference to FIGS. 21 and 28, the balled end 438 of the liner L is inserted into the slot 430 of the spool 426. With additional reference to FIG. 20, the liner L is folded back over the body 412 and the frame 420 in a manner similar to that in which a conventional waste basket liner is folded over the rim of a conventional waste basket.

To pick up waste W, the device 410 is angled slightly relative to the surface or ground being cleaned and positioned so that the opening 424 is adjacent the waste desired to be picked up. More specifically, with reference to FIG. 21, a front edge 466 of the lower wall 414 is partially inserted between the waste W and the ground or surface supporting the waste. With the edge 466 partially inserted under the waste W, a portion of the waste W rests on the liner L folded over the edge 466.

Next, the switch 450 is actuated by applying a depression force thereon which allows power to flow from the batteries B to the motor 448. Provided the spool gears 432 are in their engaged position thereby engaging the large gears 456, the motor 448 causes the spool 426 to rotate in the first direction (the direction indicated by the arrow 434 in FIG. 28). As mentioned above, rotation of the spool 426 in the first direction causes the liner L to be wound onto the barrel 428 of the spool 426 and into the opening 424. At the same time, the body 412 is moved forward along the waste W. Optionally, with additional reference to FIG. 20B, an absorbent sheet 471 can be used in conjunction with the liner L. The sheet 471 can have similar absorbent characteristics as those discussed in reference to the sheet 170, which was disclosed above in connection with the device 10. The sheet 471 additionally includes an adhesive portion 471*a* so that the sheet 471 can be readily attached to a folded-over portion of the liner L for use therewith, when desirable. Thus, use of the sheets 471*a* can be as needed and need not be used with every liner L.

As the liner is wound about the spool 426, the waste W is pulled into the device 10 on the liner L and the device 10 is manually moved toward or into the waste to continue feeding the waste to the device 10. More specifically, the static friction between the waste W and the liner L is greater than and overcomes the static friction between the waste and the surface the waste is resting upon and the relatively weak gravitational resistance action on the waste such that the waste is pulled into the device 410 as the liner is pulled toward the spool 426. The gravitational forces resisting pulling of the waste W toward the spool 426 are relatively weak because the device 410 is only slightly angled relative to the surface below the waste.

Figure 23:
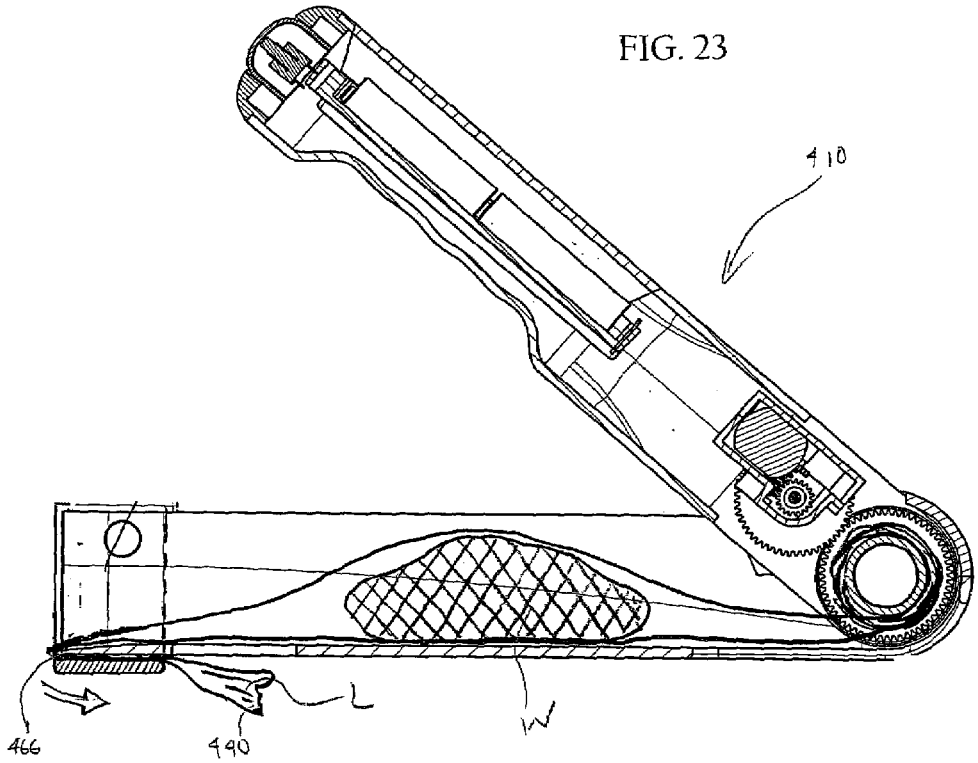
FIG. 23 is a cross-sectional view of the waste collection device of FIG. 22 showing an opening frame of the device in a closed position sealing or pinching closed an open end of the liner.

With additional reference to FIG. 23, once the waste W is pulled into the device 410, the frame 420 can be moved to its closed or nesting position. This action causes the liner L to fold over the edge 466 adjacent the open end 440 of the liner L thereby sealing the liner L closed. This traps any waste W collected in the liner L until it is desired to remove the waste. Note that the device can be held in any orientation without fear of spillage of the liner's contents, as long as the liner is pinched between the frame 420 and the body 412.

Figure 24:
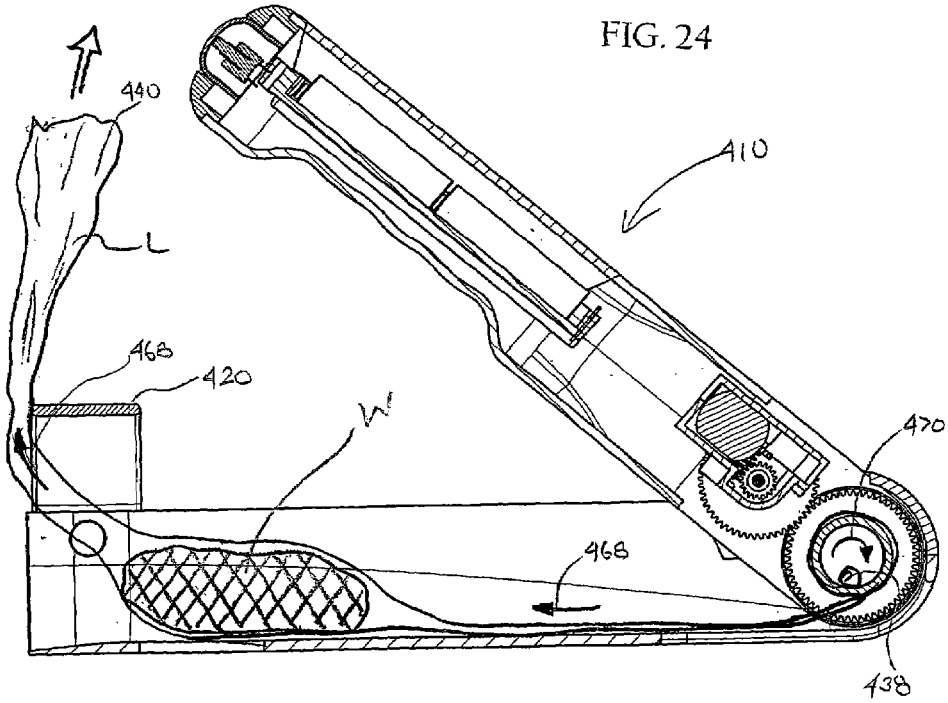
FIG. 24 is a cross-sectional view of the waste collection device of FIG. 23 showing the open end of the liner removed from the device and held together to hold the waste contained within the liner and with the closed end of the liner unwound from the spool.

To remove the liner L with the waste W container therein, it is first necessary to disengage the spool 426 from the motor 448. More particularly, with reference to FIG. 32, a user applies force F to move the spool 426 against the force of the spring 464. With additional reference to FIGS. 27 and 29, the force F is applied and held on the spool 426 maintaining the spool 426 in its disengaged position. While in the disengaged position, with additional reference to FIG. 24, the user also grasps the open end 440 of the liner L or any portion of the liner L between the open end 440 and the area of the liner being pinched by the frame 420. The user holds the open end 440 closed at least until the liner L is removed. The liner L could also be permanently closed by a clamp, a wire tie or via a known zip-lock type arrangement.

Next, the frame 420 is pivoted from the closed position to the open position. Then, with the spool 426 held in its disengaged position and free to rotate, the liner L can be pulled from the body 412 in the direction of arrows 468 and unwound from the spool 426 as it is pulled, i.e., the spool 426 rotates in the second direction shown by arrow 470. The balled end 438 is removed from the spool 426 and, thereafter, the liner L with the waste W therein can be discarded.

Figure 30:
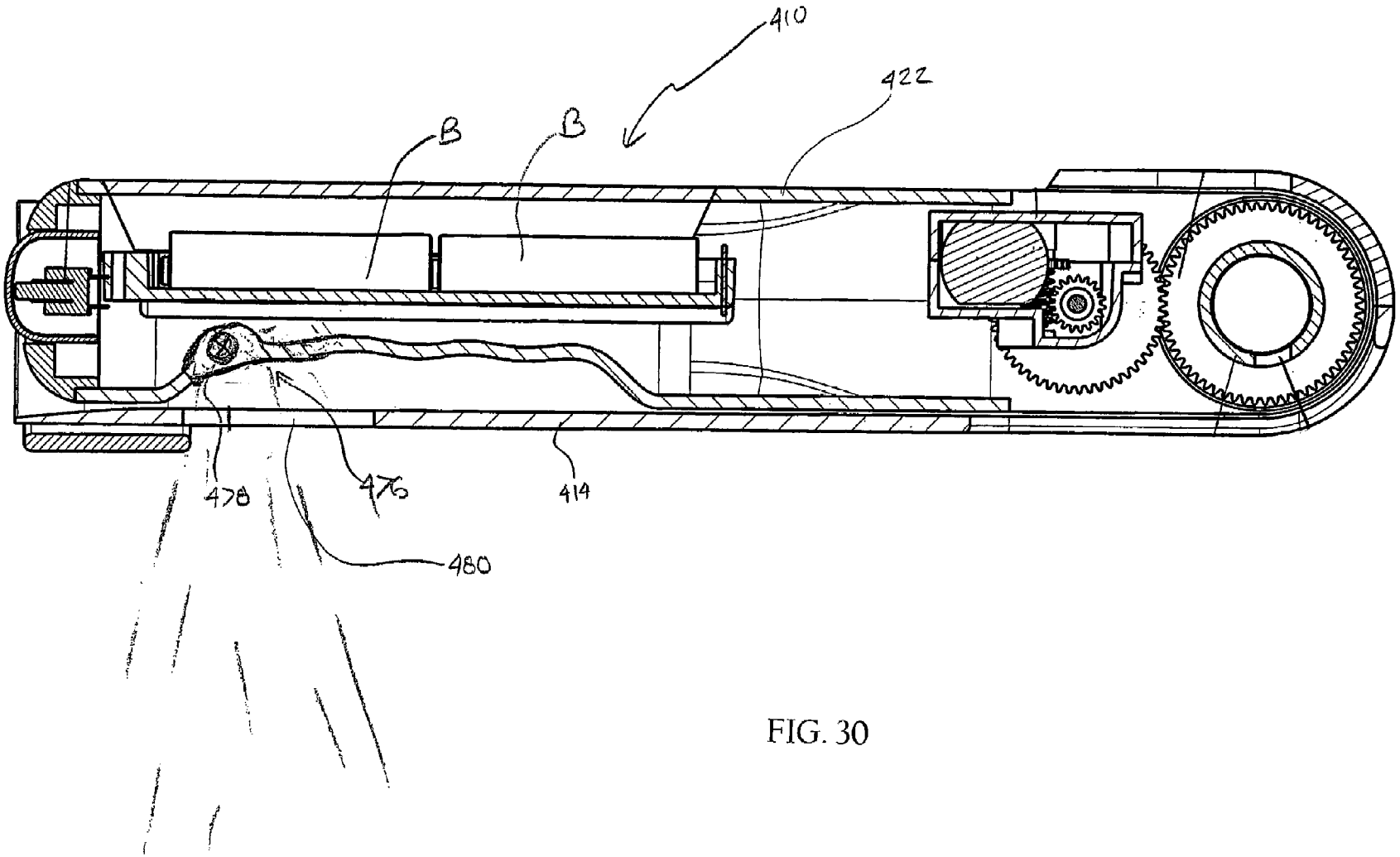
FIG. 30 is a cross-sectional view of a fold-up waste collection device having a light according to another embodiment of the present invention.
Figure 31:
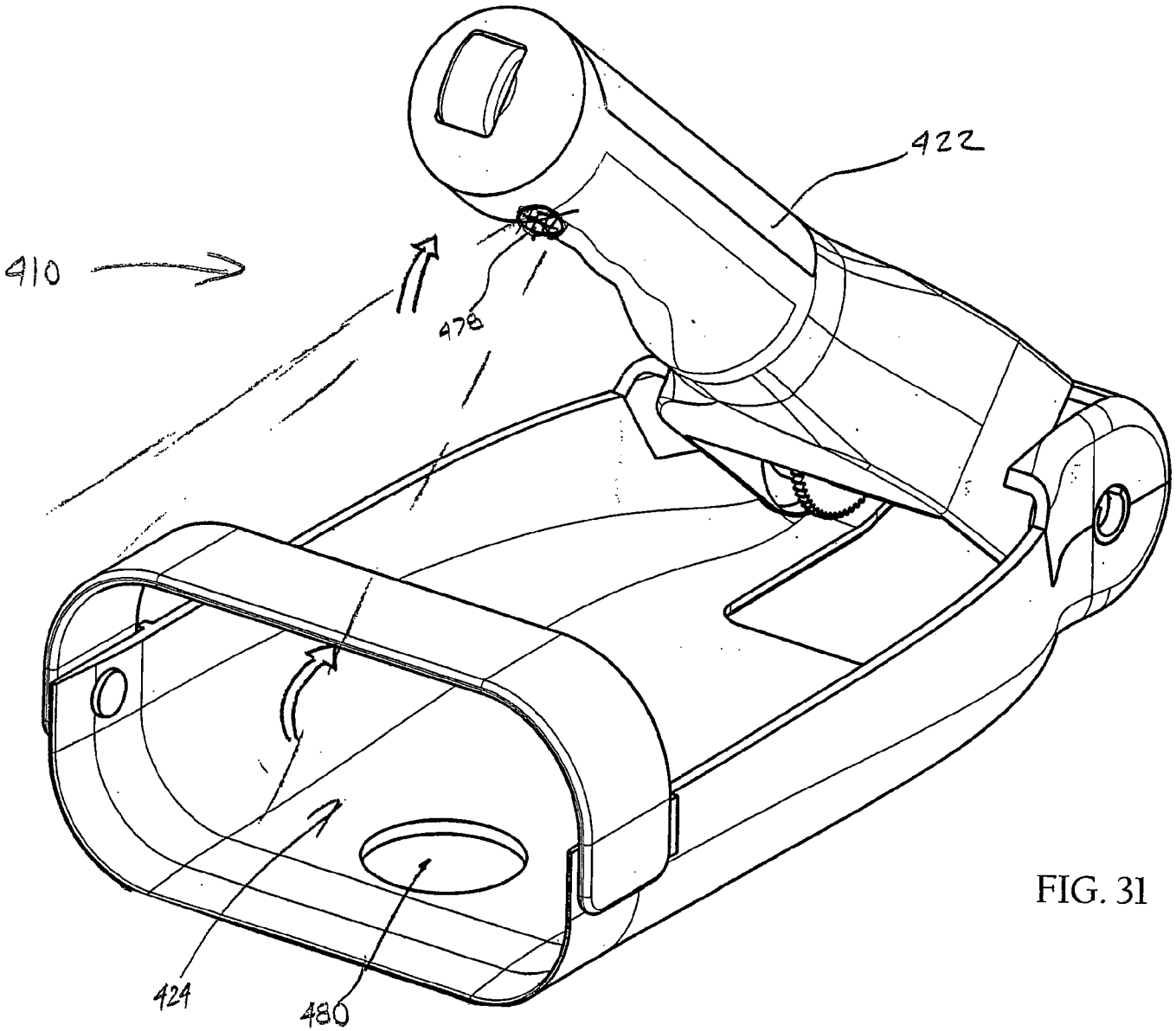
FIG. 31 is a perspective view of the waste collection device of FIG. 30 shown in a partially unfolded position.

With reference to FIG. 30, the device 410 can optionally include a lighting assembly 476. More specifically, a forward portion of the handle 422 can include the lighting assembly 476 which includes a light source 478, such as a conventional battery powered light bulb, that produces a light beam. The light source 478 can be oriented such that the light beam is directed through an opening 480 in the lower wall 14 when the handle 422 is in the folded down position and, with additional reference to FIG. 31, toward the front of the device 410 for illuminating an area in front of or adjacent the opening 424 when the handle 422 is in the unfolded position.

When included in the device 410, the light source 478 can be selectively electrically connected to the batteries for providing power thereto. More specifically, the switch 450 can be configured for selectively operating the light source 478 by serving as an electrical switch between the batteries B and the light source 478. Thus, when the switch 450 is depressed, power is allowed to flow from the batteries B to the light source 478 and power is also allowed to flow from the batteries B to the motor 448. Alternatively, the switch 450 can be configured as a two-position switch wherein depression to a first position only allows power to flow from the batteries B to the light source 478 and further depression to a second position additionally allows power to flow from the batteries B to the motor 448. Of course, other configurations are also possible including providing an entirely separate switch (not shown) apart from the switch 450 for selectively actuating the light source 478 and using the switch 450 only for selectively actuating the motor 448 or vice versa.

In all configurations, the switch 450 can include a biasing means such as a spring for urging the switch 450 toward its extended, i.e., non-depressed, position. Accordingly, when a user is no longer depressing the switch 450, the switch returns to its extended position wherein the electrical connections from the batteries B to the light source 478 and/or the motor 448 are interrupted. Although batteries are shown and described as the power source for powering the light source 478 and the motor 448, it is to be appreciated that any other power source could be used in place of the batteries B. For example, the device 410 could be alternatively configured to operate using conventional AC power or rechargeable batteries.

Figure 32:
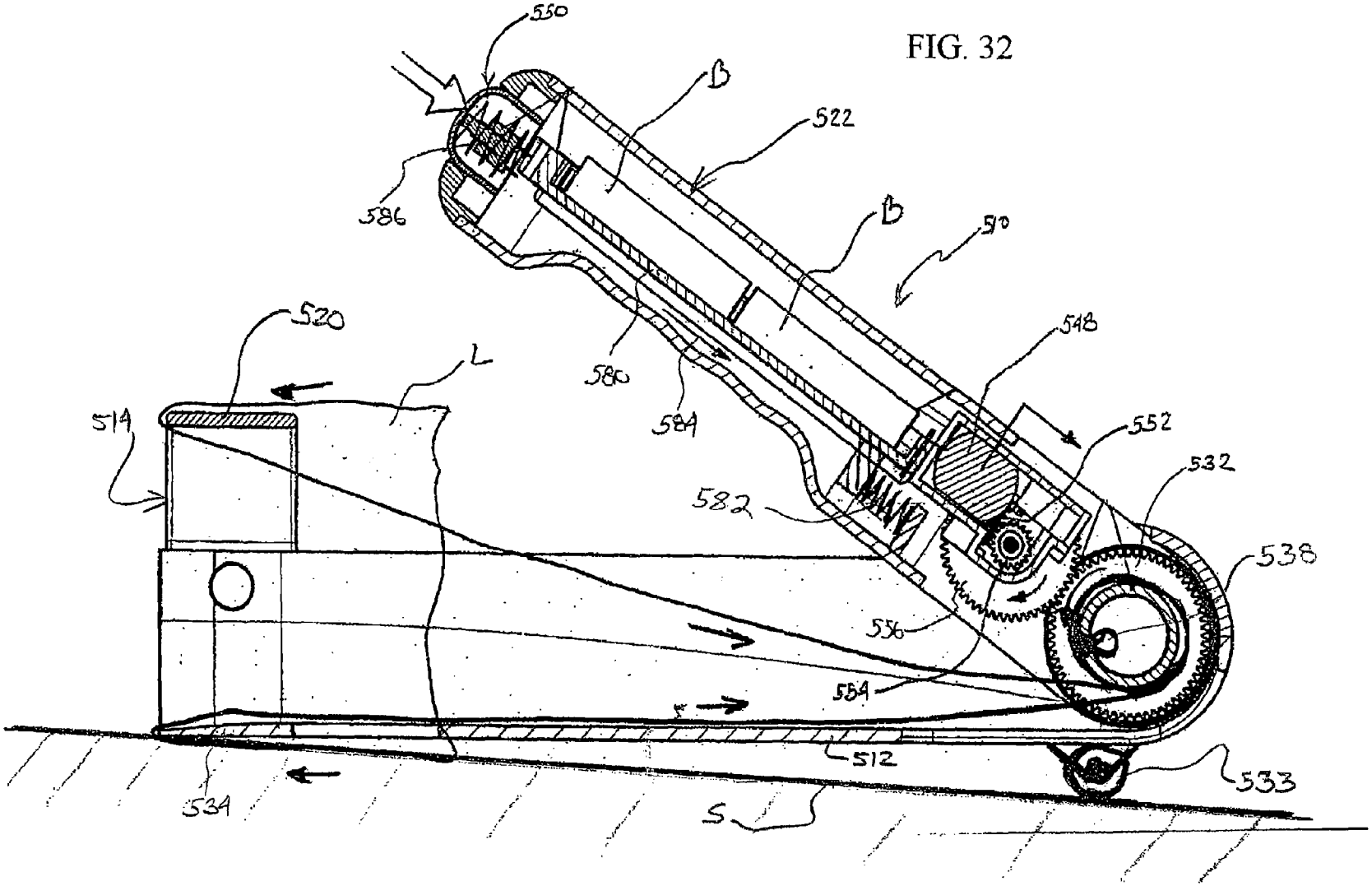
FIG. 32 is a cross-section view of a fold-up waste collection device having an alternate gear clutch arrangement according to yet another embodiment of the present invention shown in an engaged position.

With reference to FIG. 32, a waste collection device 510 is shown in accordance with another preferred embodiment of the present invention. The device 510 includes an alternative means for engaging and disengaging spool gears 532 from large driving gears 556. As described above, the device 410 allows the spool 426 to axially move relative to the large gears 456 when a knob 460 was pushed in and held thereby moving the spool gears 432 out of engagement with the large gears 456. In contrast, the device 510 allows the large gears 556 to move linearly relative to a rotational axis of the spool gears 532. Additionally, the device 510 optionally includes one or more wheels 533 for facilitating movement of the device 510 across a surface S, particularly when the device 510 is moved into or toward waste. In the illustrated device 510, a single wheel or set of wheels is provided adjacent an end of the device 510 opposite opening 514. Of course, other wheel configurations are possible and all such wheel configurations are to be considered within the scope of the present invention. For example, a second set of wheels could be provided adjacent the opening 514 and lip portion 534 could be modified to extend downward to the surface S. In most other respects, the device 510 is constructed and used as described above in reference to the device 410.

Figure 33:
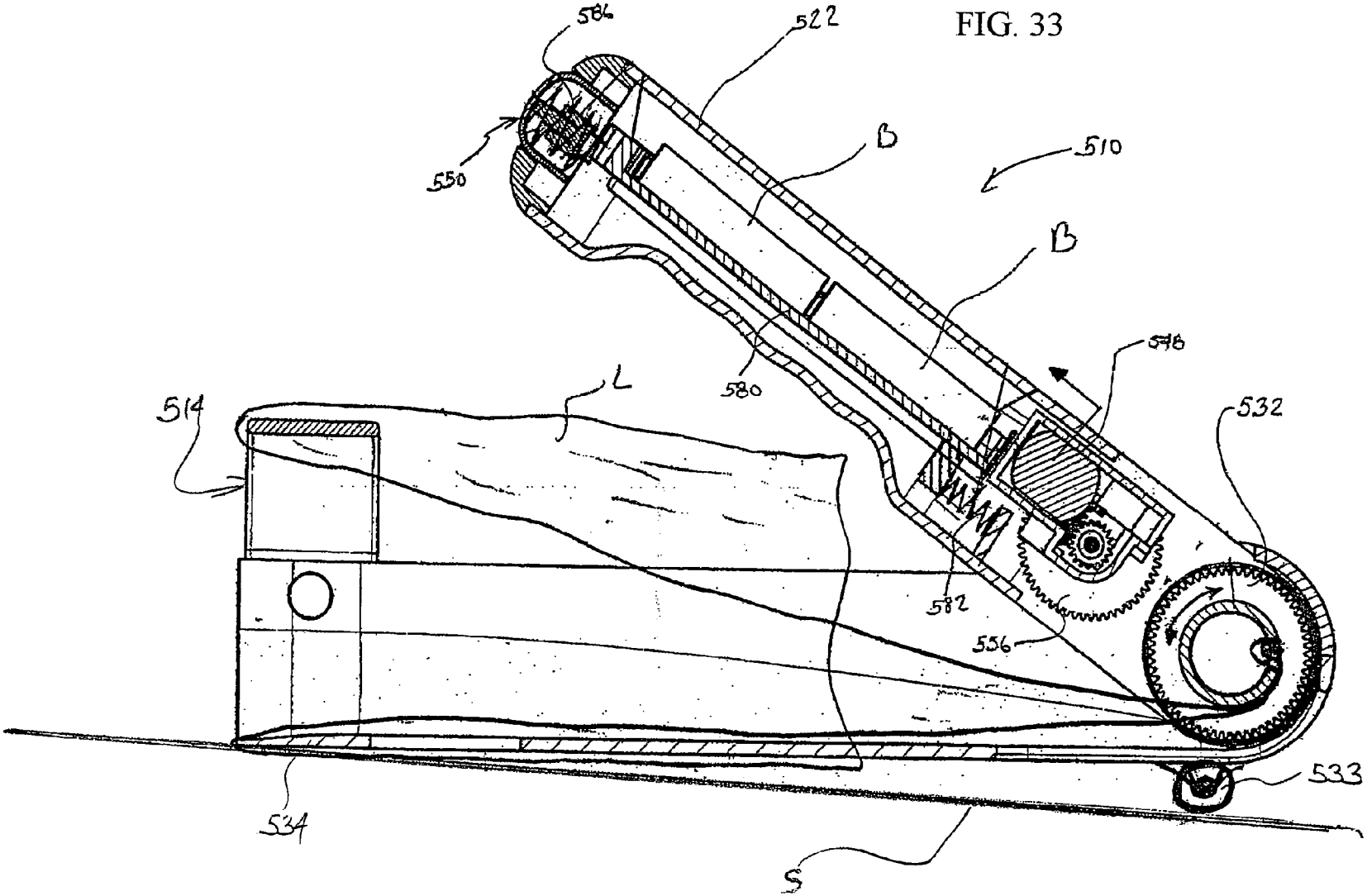
FIG. 33 is a cross-sectional view of the waste collection device of FIG. 32 showing the alternative gear clutch arrangement in a disengaged position.

Concerning the linear movement of the large gears 556, switch 550 is provided for moving the gears 556 into an engaged position wherein teeth of the gears 556 mesh with teeth of the spool gears 532. Thus, the spool gears 532 are only engaged to the gears 556 when a sufficient force is applied to the knob 550. More specifically, handle 522 of the device 510 includes a mounting structure 580 that is slidably movable along a length of the handle 522. The mounting structure 580 is configured to hold batteries B, motor 548 and gears 552,554,556. The mounting structure 580 is urged toward a normal, disengaged position shown in FIG. 33 by a biasing means such as a spring 582. In the disengaged position, the large gears 556 are spaced apart and disengaged from the spool gears 532 and the spool 526 is free to rotate. Thus, the means for disengaging the spool gears 532 includes the movable mounting structure 580 and the spring 582 urging the movable mounting structure 580 and its gears 556 away from the spool gears 532.

Upon depression of the switch 550 with enough force to overcome the urging of the spring 582, the mounting structure 580 moves in the direction of arrow 584 until the gears 556 come in contact with and engage the spool gears 532, i.e. the engaged position. Upon further depression of the switch 550 with enough force to overcome the urging of another biasing means such as spring 586, the motor 548 is selectively actuated for rotating the spool 526 as described above in reference to the device 410. When force is no longer applied to the switch 550, it returns to its extended position due to the spring 586 and the mounting structure 584 returns to its normal, disengaged position due to the urging of the spring 582. Preferably, the spring 586 is stronger than the spring 582 so that the gears 552 and 532 engage first and only then is motor 548 activated.

Figure 34:
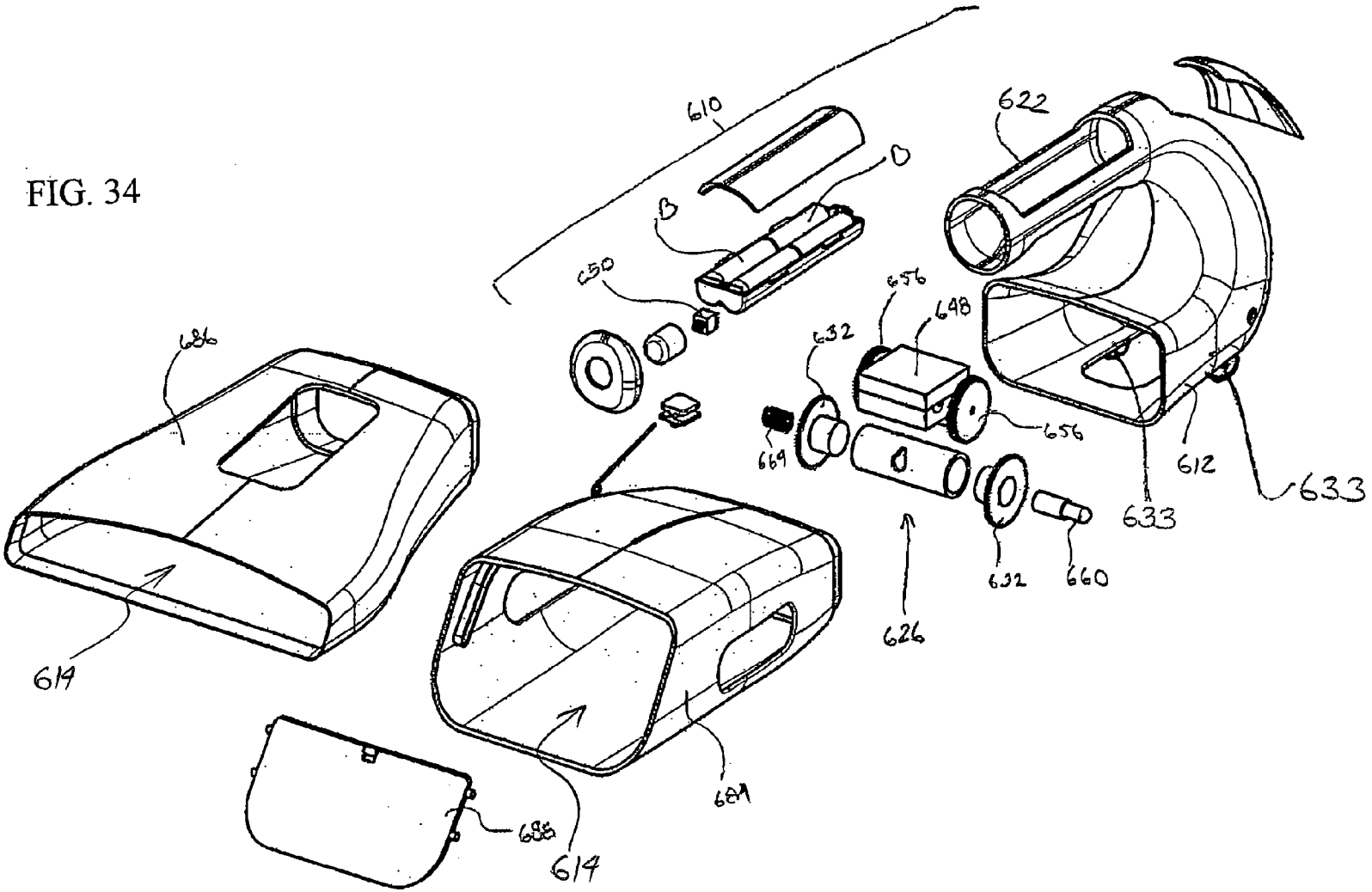
FIG. 34 is an exploded view of a waste collection device having a U-shaped handle and adapted for use with various housing attachments according to still another embodiment of the present invention.

With reference to FIG. 34, a waste collection device handle assembly or device 610 is shown in accordance with yet another preferred embodiment of the present invention. The device 610 includes a generally U-shaped housing 612 having a handle section 622. In most respects, the device 610 is like the device 410 and operates like the device 410. For example, with additional reference to FIG. 35, the device 610 includes spool 626 rotatably mounted to the housing 612 and having spool gears 632. The device includes motor 648 and driving gears 656. Knob 660 is provided for axially moving the spool 626 and disengaging the spool gears 632 from the large gears 656 when a force is applied to the knob 660 sufficient to overcome the resistance of spring 664. The spring 664 urges the spool 626 back toward its engaged position. Batteries B are mounted in the handle section 622 and a switch 650 is mounted at the distal end of the handle section 622.

One difference from the device 410 is that the housing 612 is a main housing that is shaped such that different nozzles or housing attachments 684,686 can be removably attached thereto. For example, the attachment 684 is a large opening attachment that includes a door 688. Operation of the door 688 is like the door 66 of the above-described device 10. The other attachment 686 is a wide mouth attachment. Of course, other attachments could be used and all types of other known attachments are to be considered as contemplated for use with the device 610. Like the device 510, the device 610 optionally includes wheels 633 for facilitating movement of the device 610 across a surface. Also like the device 510, other wheel configurations are to be considered within the scope of the present invention. Although wheels are shown on only devices 510 and 610, it should be understood by those skilled in the art that wheels, in one of a variety of configurations, could be added to any of the embodiments described or discussed herein, if desirable.

Figure 35:
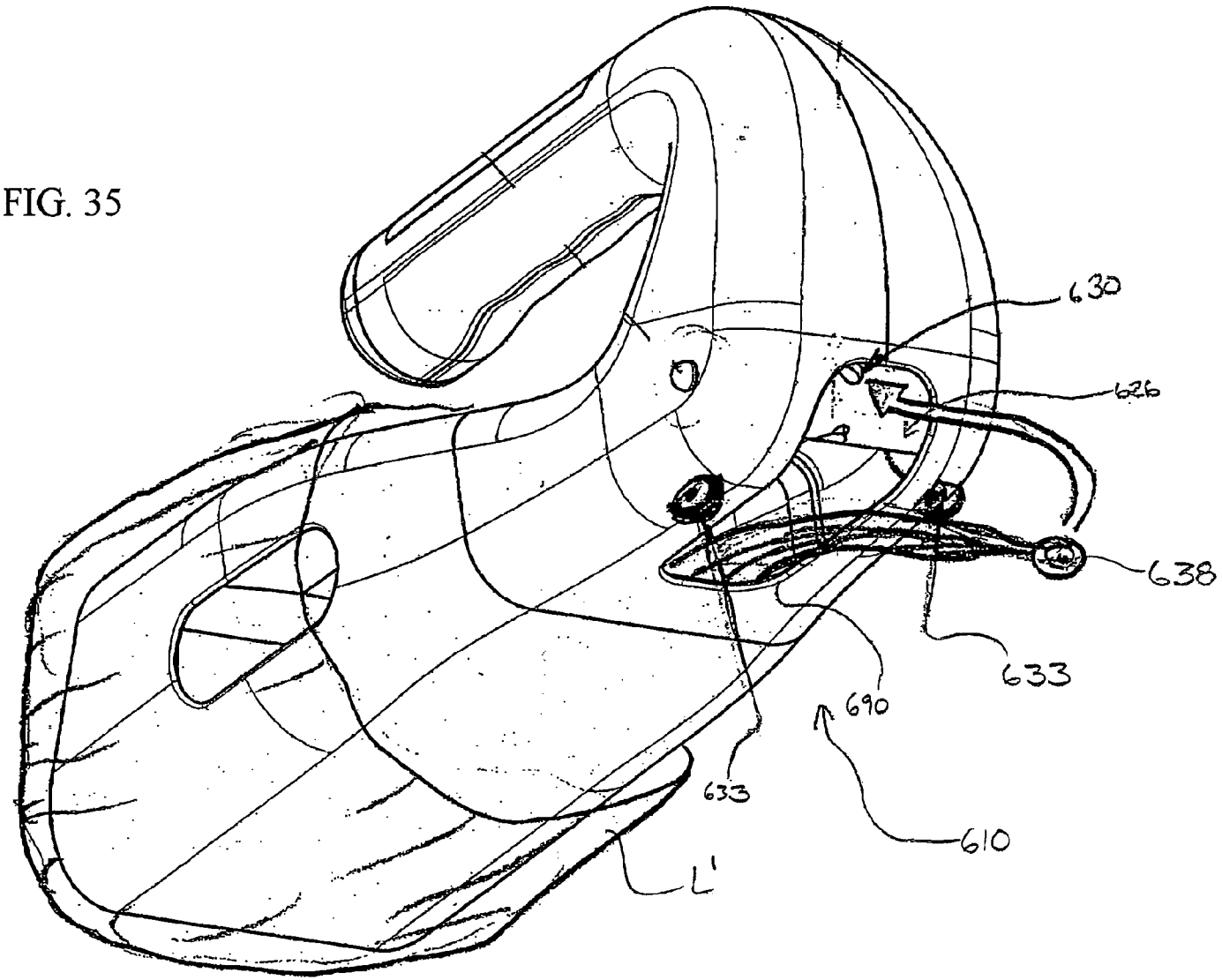
FIG. 35 is an underside perspective view of the waste collection device of FIG. 34 to which one front end attachment of FIG. 18 is secured.

With reference to FIG. 35, the device 610 includes an opening 690 adjacent the spool 626 for facilitating attachment of an enlarged end of liner L to the spool 626. The opening 690 is deemed particularly useful in the device 610 because the housing 612 limits easy access to the spool 626 from a top side of the device 610. With reference to FIG. 22, the device 410 could also be provided with an opening 490 for facilitating attachment of the liner L to the spool 426.

Figure 36:
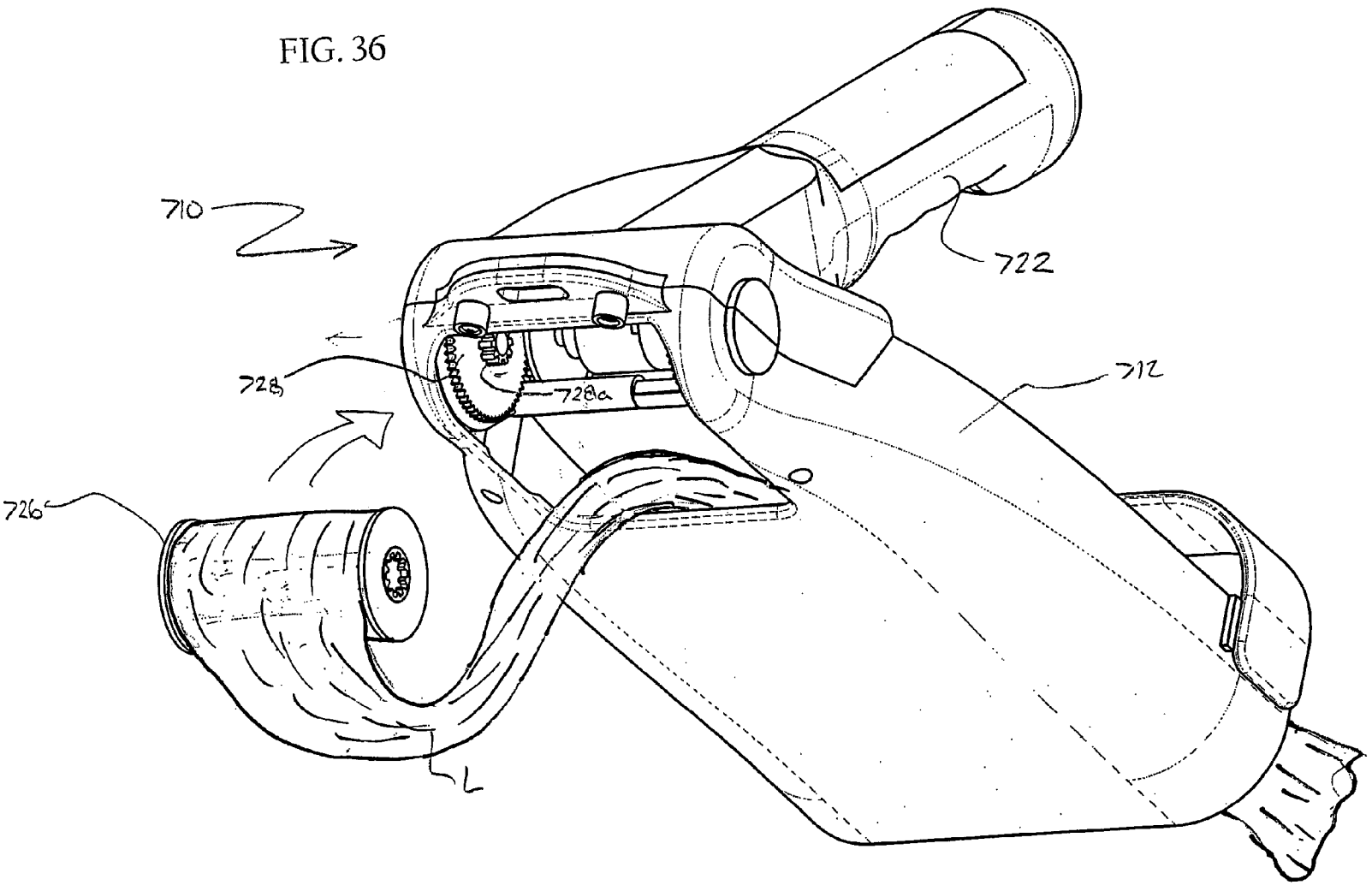
FIG. 36 is an underside perspective view of a waste collection device and a removable spool according to still yet another embodiment of the present invention.

With reference to FIG. 36, a waste collection device 710 for use with a removable spool 726 is shown in accordance with still yet another preferred embodiment of the present invention. Besides having a removable spool 726, in most other respects, the device 710 is like the device 410 and only the differences from the device 410 will be described herein.

Figure 37:
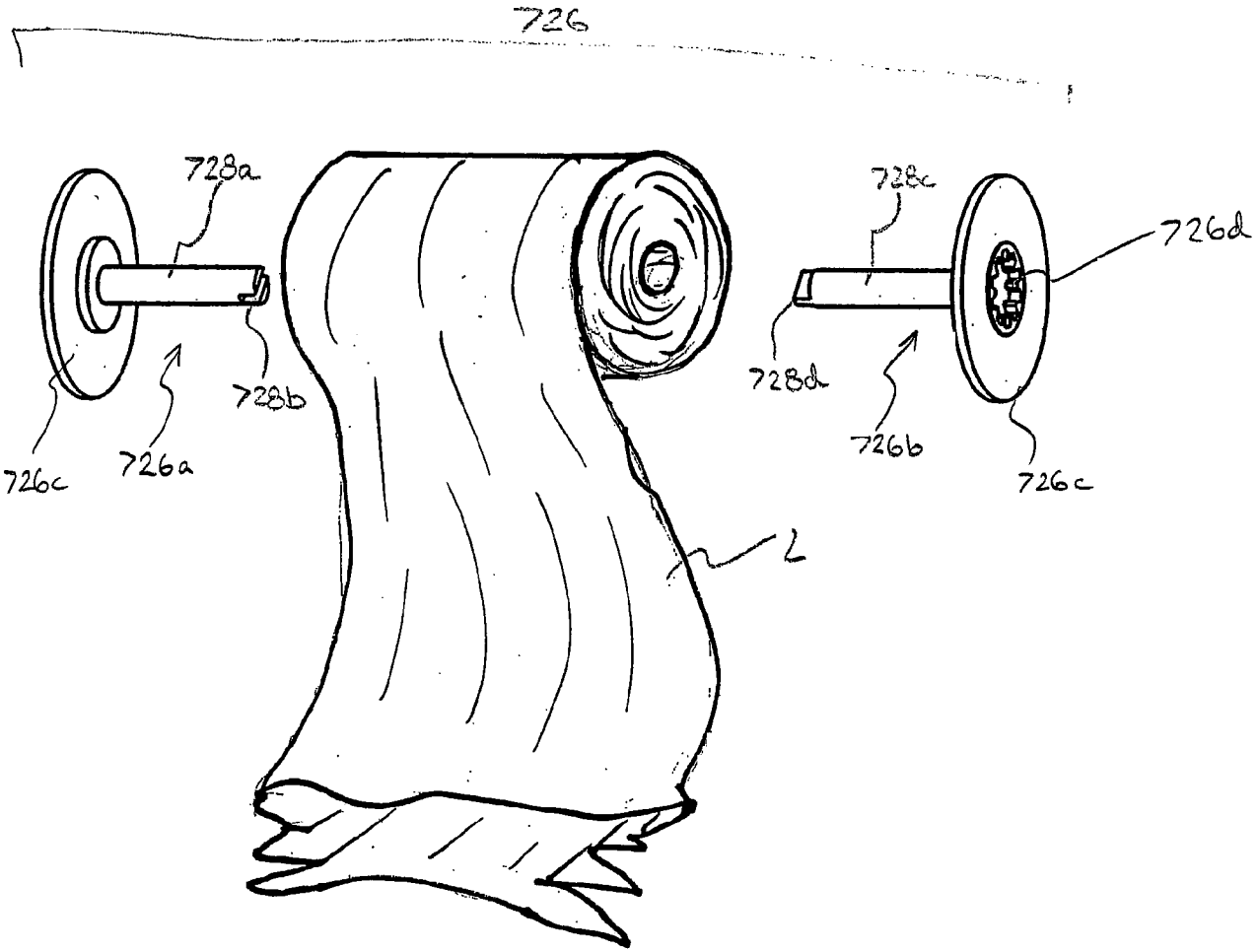
FIG. 37 is an exploded perspective view of the removable spool of FIG. 36.

With additional reference to FIG. 37, the removable spool 726 includes a first spool section 726*a* removably connectable to a second spool section 726*b*. The first section 726*a* includes a first barrel portion 728*a* having a receiving slot 728*b* at a distal end thereof. The second section includes a second barrel portion 728*c* having a connecting tab 728*d* at a distal end thereof. The connecting tab 728*d* is configured to be inserted into the slot 728*b* to connect the first and second spool sections 726*a*,726*b* together. When connected together, the barrel portions 728*a*,728*c* are capable of supporting a roll of liners L. The two-component spool 726 allows the entire roll of liners L to be easily positioned on the spool 726 and allows a replacement roll of liners to be used without replacing the spool 726.

Each spool section 726*a*,726*b* includes a rim 726*c* for holding the roll of liners L on the barrel 728*a*,728*c* and each of the rims 726*c* includes gear-type recess 726*d* (only one shown in FIGS. 36 and 37) for transferring motion from the motor (not shown) of the device 710 to the spool 726. The device includes spool gears 732 that are driven by the motor as described in reference to the device 410. Each of the spool gears 732 includes mating gears 728*a* (only one shown in FIG. 36) that cooperate with and are received within the recesses 726*d* for rotating the spool 726 when the spool is mounted in the device 710. Of course, other configurations between the spool 726 and the spool gears 732 are possible, including, for example, a square recess and a square projection from the spool gears 732, and all known configurations are to be considered within the scope of the present invention.

Figure 38:
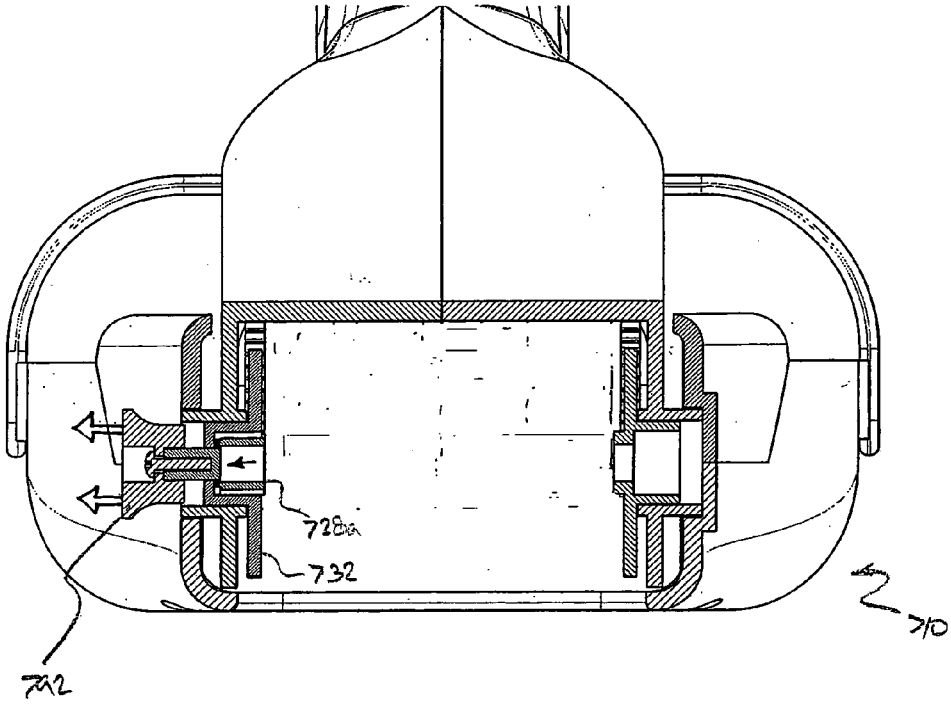
FIG. 38 is a cross-sectional view of the waste collection device of FIG. 36 showing a mounting gear in a first, open position.
Figure 39:
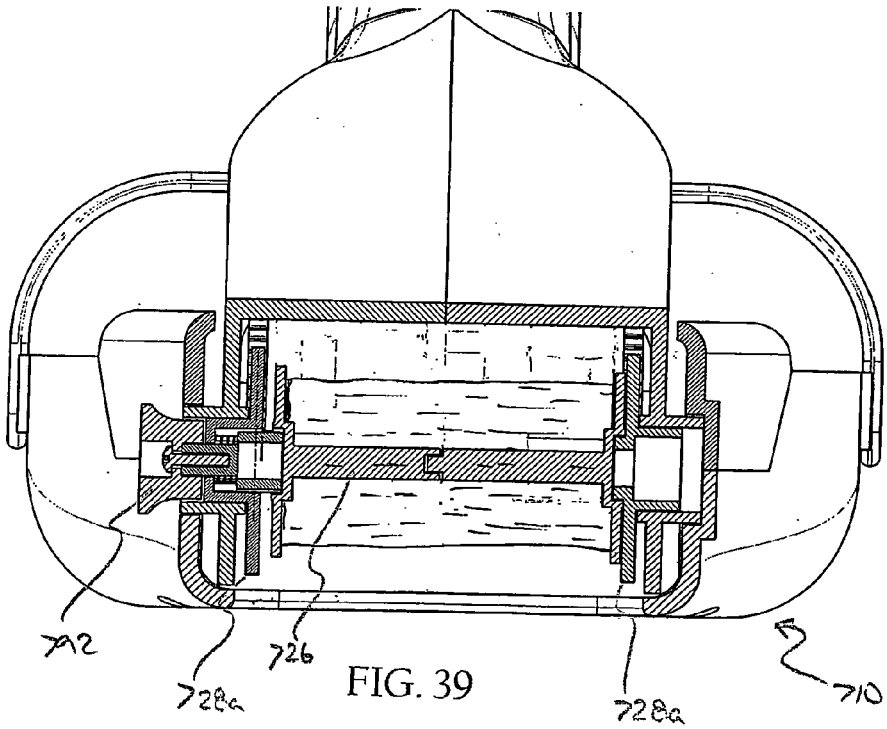
FIG. 39 is a cross-sectional view of the waste collection device of FIG. 36 showing the removable spool mounted in the device and the mounting gear in a second, locked position.

With reference to FIGS. 38 and 39, the mating gear 728*a* on one of the spool gears 732 is movable between an open position and an engaged position. In the open position, the mating gear 728*a* is retracted within its spool gear 732 which provides sufficient space for installing the spool 726 between the spool gears 732. The movable mating gear 728*a* is connected to a handle 792 that extends out of a side of the device 710. Thus, the handle 792 is used to move the movable gear 728*a* between its open position and its engaged position.

With specific reference to FIG. 39, once the spool 726 is installed between the spool gears 732, the movable mating gear 728*a* can be moved to its engaged position via the handle 792 wherein both the mating gears 728*a* are locked in engagement with their respective gear recesses 726*d*. In this position, the motor can be use to rotate the spool 726 as described in reference to the device 410.

Figure 40:
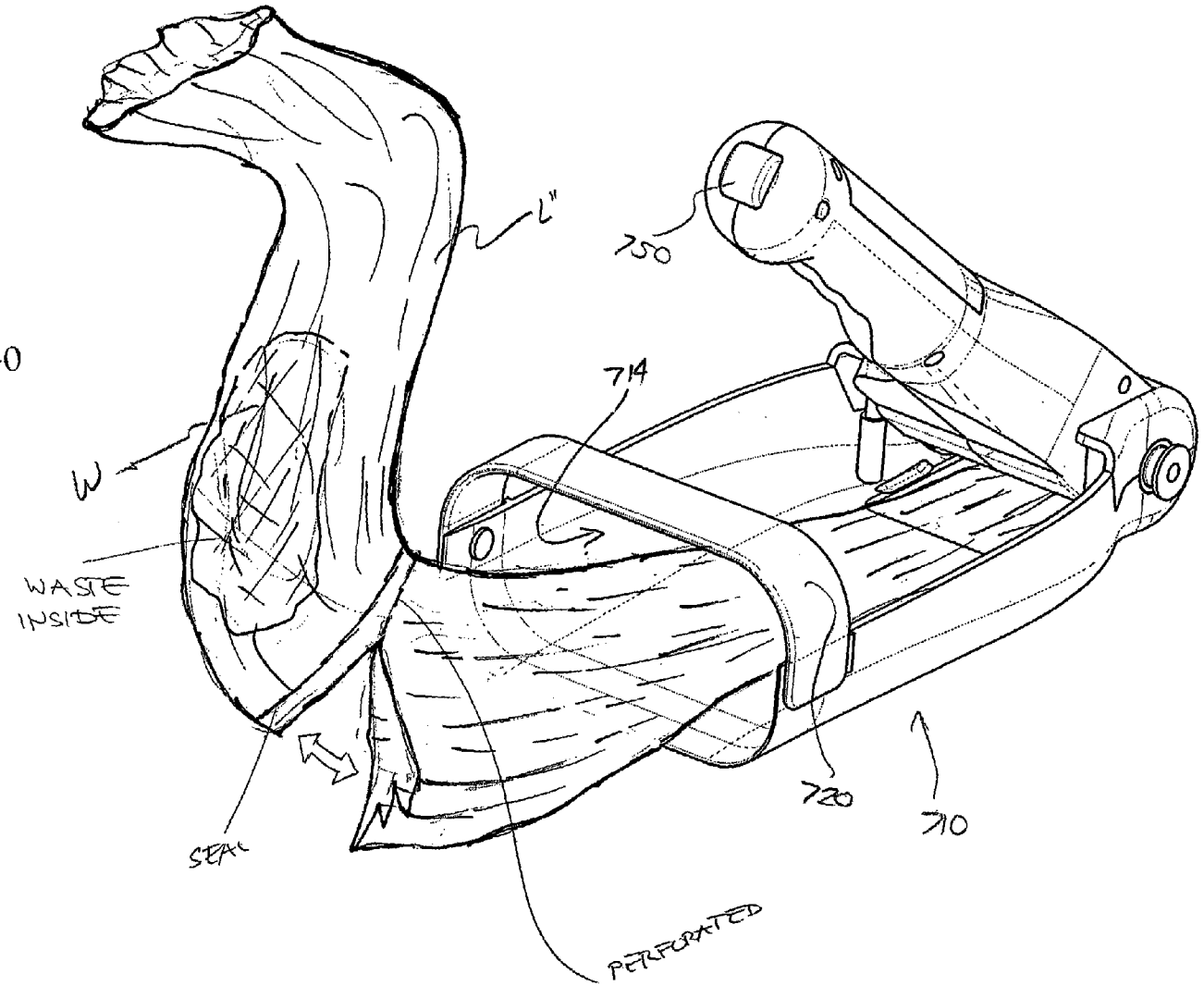
FIG. 40 is a top side perspective view of the waste collection device of FIG. 36 showing one liner being removed from a plurality of liners wound on the removable spool.

With reference to FIG. 40, the device 710 can be used to remove or pick-up waste W as described in reference to the device 410. However, once the waste is removed and the used liner L is to be discarded, the next liner L on the roll is ready for use and does not have to be separately connected to the spool 726 as it is already connected thereto.

Figure 41:
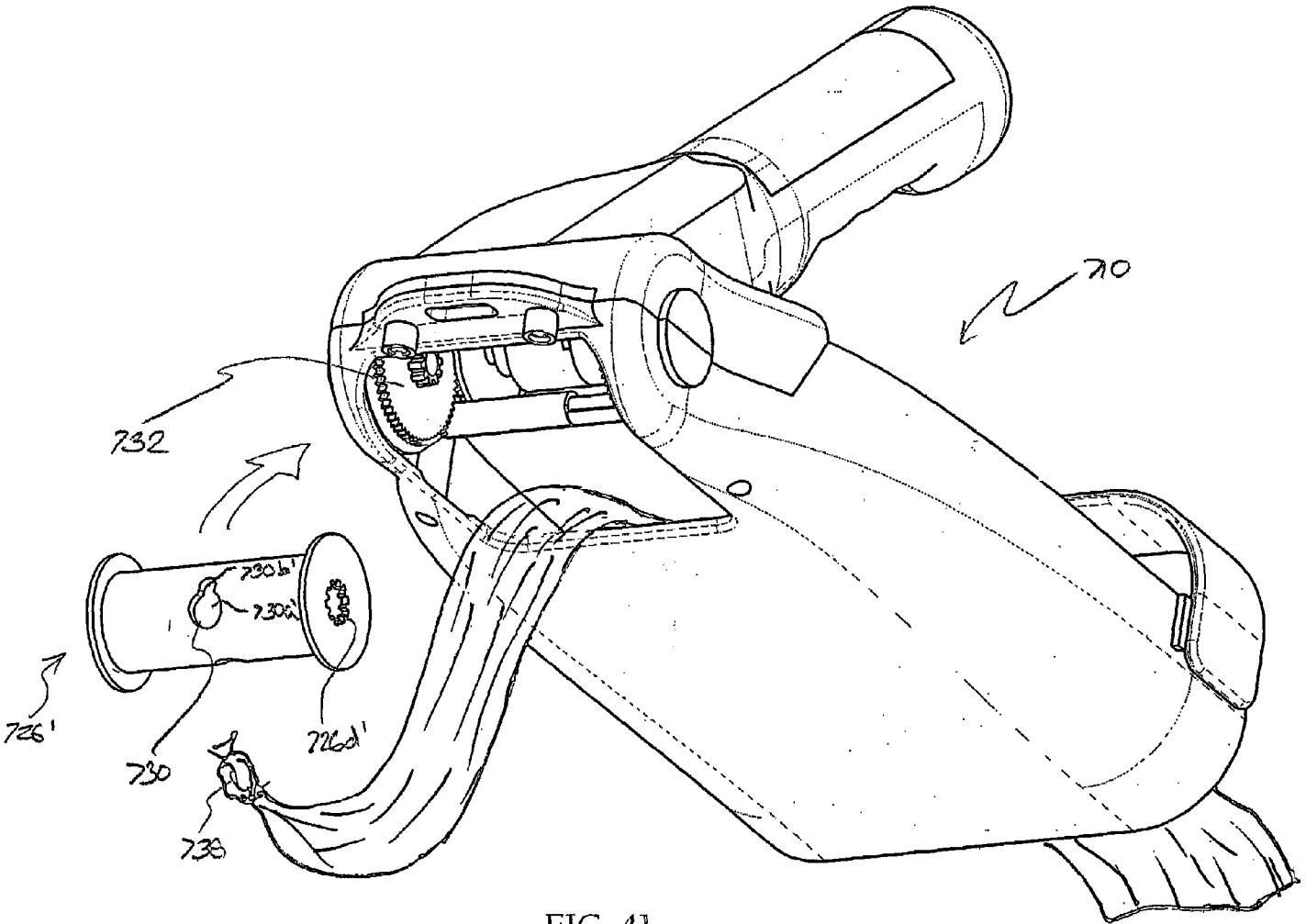
FIG. 41 is an underside perspective of the waste collection device of FIG. 36 and an alternative removable spool.

With reference to FIG. 41, an alternate spool 726' is shown for use with the device 710. The spool 726' is removable but is adapted for a single use with a single liner L. The spool 726' includes a bag attachment slot 730' for receiving the balled end of the liner and includes the gear recesses 726' for mating with the spool gears 732 of the device 710. More specifically, the slot 730' includes a large diameter portion 730*a*' connected to a small diameter portion 730*b*'. The large diameter portion 730*a*' is appropriately sized to receive the balled end of the liner L and the small diameter portion 730*b*' is appropriately sized to hold onto the balled end when the spool 726' is rotated in the first direction to pull the liner L into the device 710.

Figure 42:
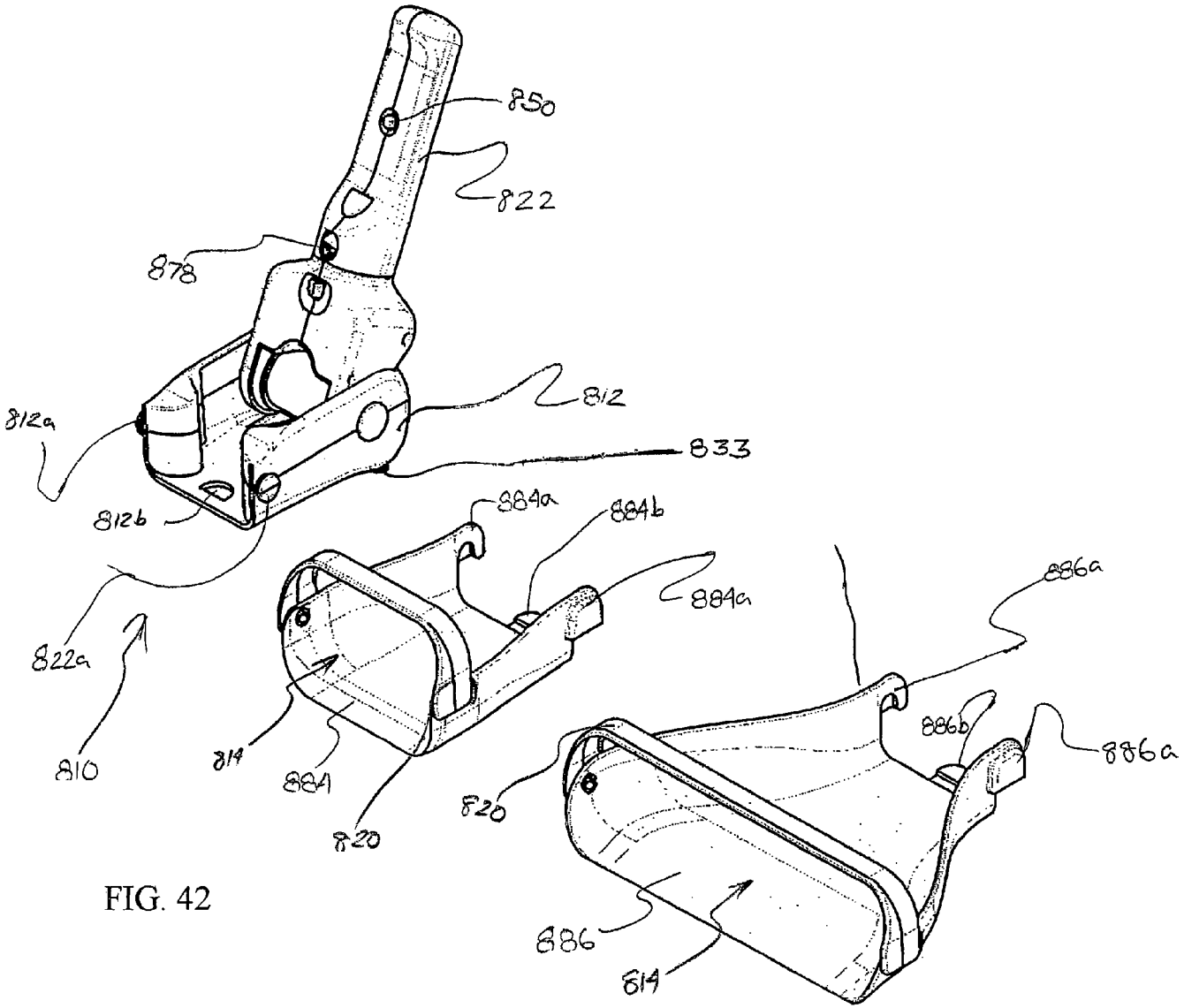
FIG. 42 is a perspective view of a waste collection device having a telescoping handle and adapted for use with various housing attachments according to another embodiment of the present invention.
Figure 43:
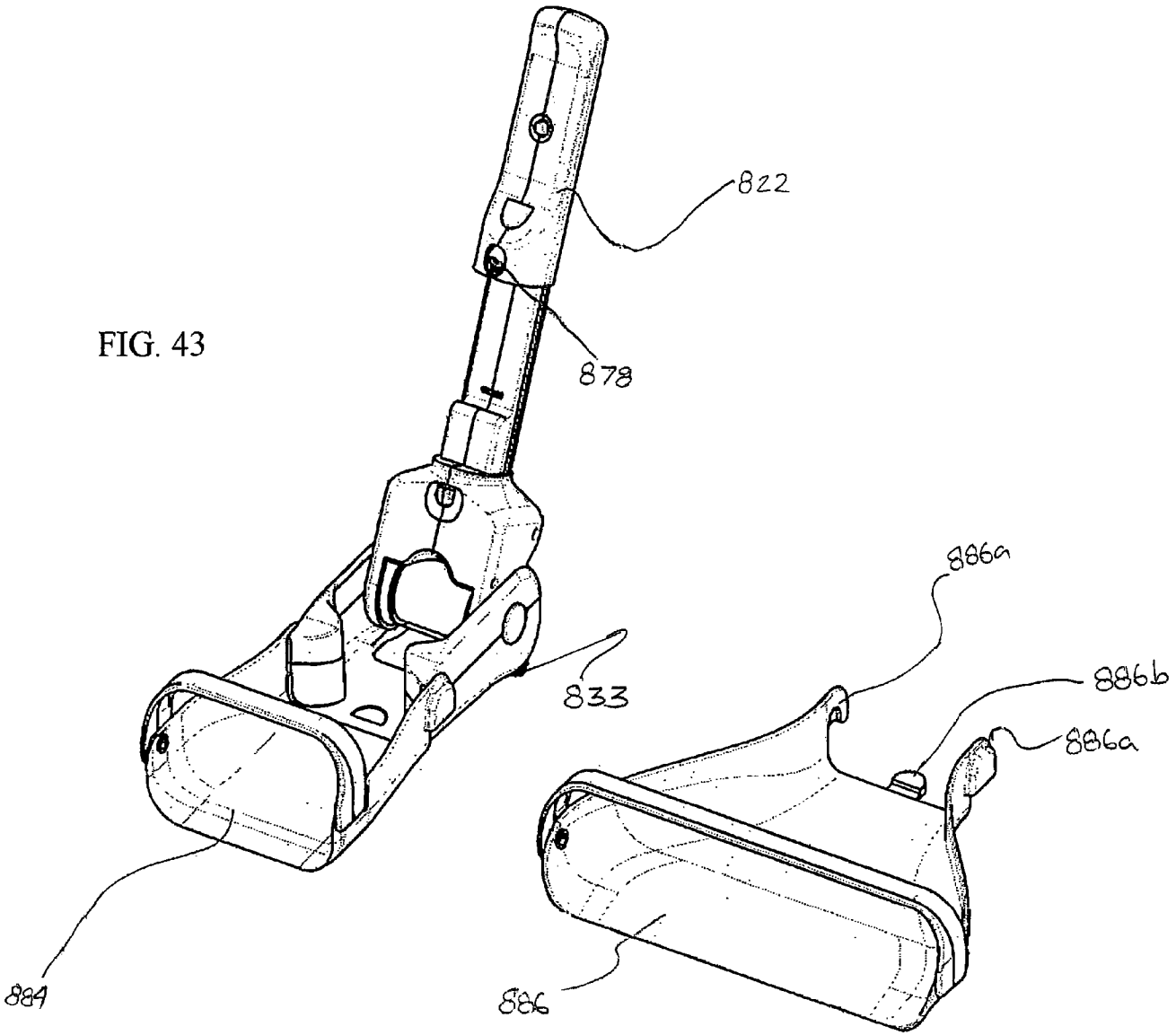
FIG. 43 is a perspective view of the waste collection device of FIG. 42 showing one housing attachment connected to the device 10 and the telescoping handle in an elongated, extended position.

With reference to FIGS. 42 and 43, a waste collection device 810 is shown in accordance with another preferred embodiment of the present invention. The device 810 includes a telescoping handle 822 which telescopingly folds down for compact storage (shown folded-down in FIG. 42) and telescopingly extends or elongates when the device 810 is to be used to remove waste (shown extended in FIG. 43). The handle 822 additionally pivotally folds up or down like the handle 422 of the device 410.

Like the device 610, the device 810 is adapted for use with different nozzles or housing attachments 884,886. Thus, a housing of the device 810 is formed by a main housing portion 812 and one of the attachments 884 or 886. With one of the attachments connected, the device functions much like that of the device 410. One difference, however, is that the attachments 884,886 are removably connectable to the housing portion 812. As with the device 610, all types of attachments could be used and all types of known attachments are to be considered as contemplated for use with the device 810, including the illustrated large opening attachment 884 and the wide mouth opening attachment 886.

For facilitating relatively easy attachment and detachment of the housing attachments 884,886, hooks 884*c*,886*c* and snap connectors 884*b*,886*b* are provided, respectively, on the attachments 884,886. The housing portion 812 includes pins 812*a* and connector opening 812*b* for receiving and connecting to the hooks and snap connectors of the attachments 884,886. Of course, although not illustrated, these features could be employed on the device 610.

Other features discussed in reference to one or more of the previous embodiments can also be optionally included on the device 810. For example, a lighting assembly having a light source 878 and/or one or more wheels 833 could be added to the device 810. Additionally, the device 810 can include further features to further ease use thereof. For example, detents could be employed to lock the handle in particular positions, such as, for example, pivotally folded down, pivotally folded open, telescopingly folded down and/or telescopingly extended. Alternatively, frictional or interference-type fits could be used for locking the position of the handle as is known to those skilled in the art. It should be understood that the features discussed herein for locking a position of a handle could be employed on other embodiments discussed herein, as should be evident to those skilled in the art.

Figure 44:
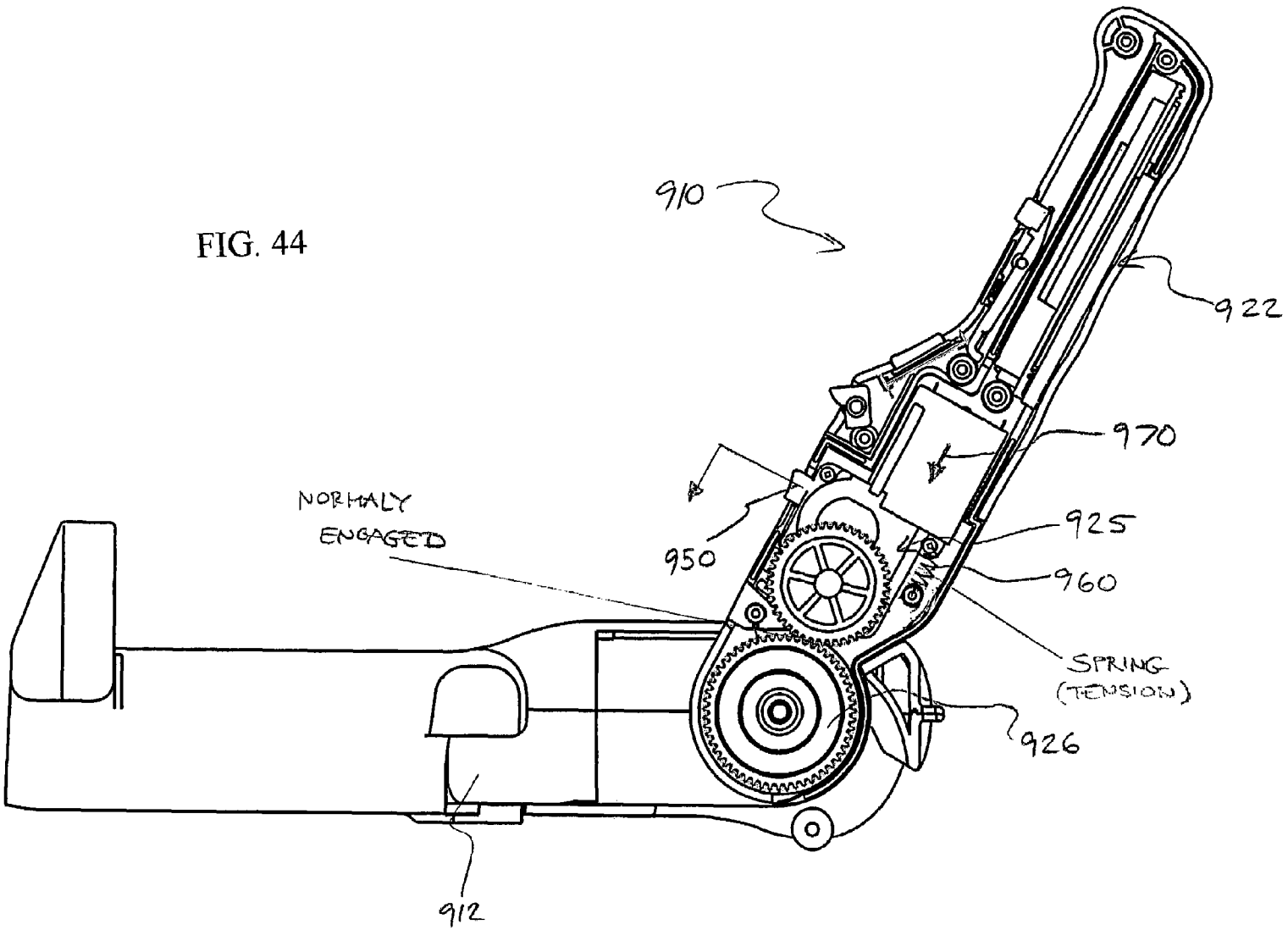
FIG. 44 is a cross-sectional view of a waste collection device according to yet another embodiment of the present invention.
Figure 45:
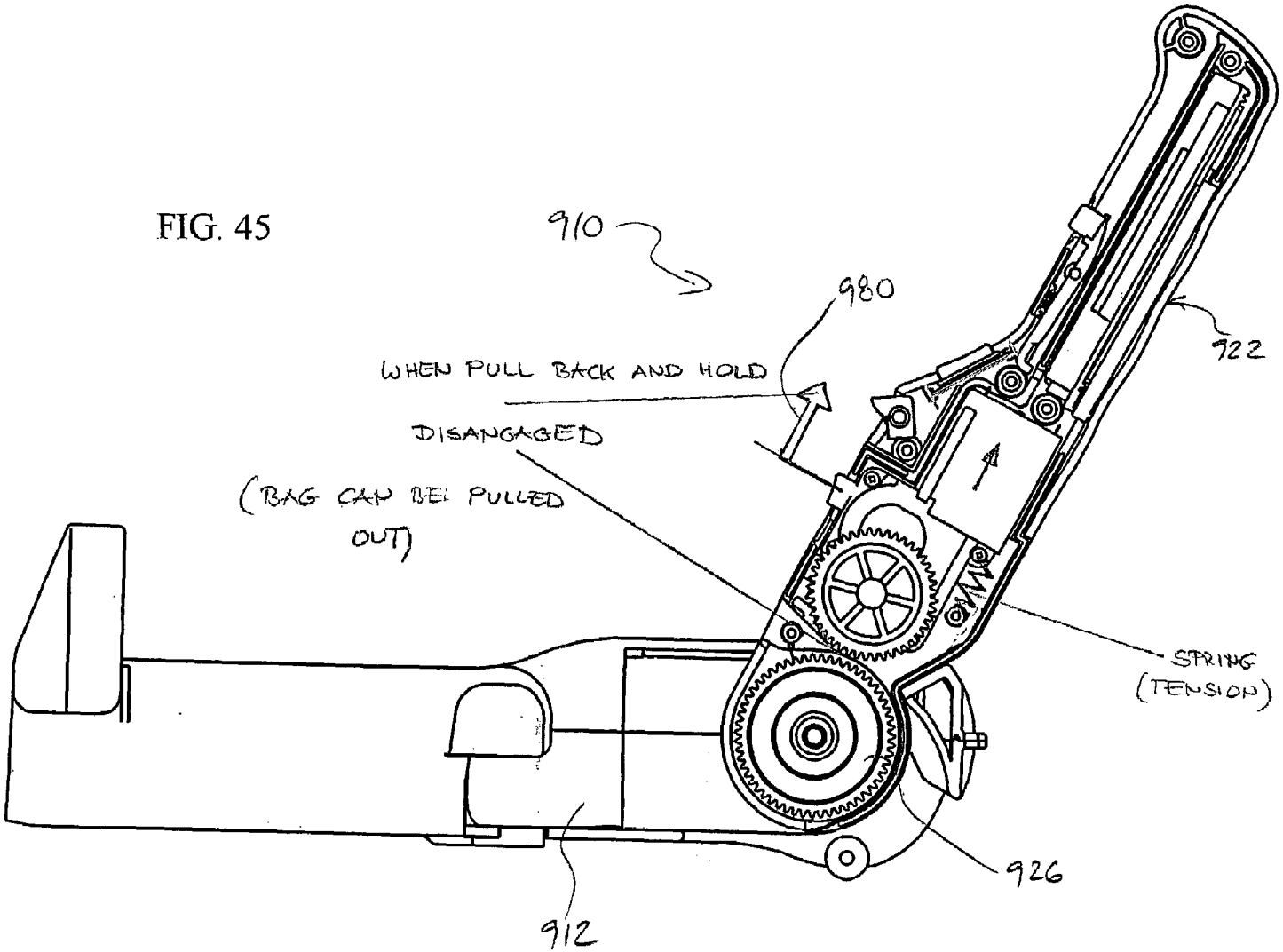
FIG. 45 is a cross-sectional view of the waste collection device of FIG. 44.

FIGS. 44 and 45 disclose another device 910 including a body 912 and a handle 922. In this embodiment, a transmission assembly 925 is selectively spaced from a spool 926 by a spring-biased actuator 950. A compression spring 960 normally pulls the actuator downwardly as shown by arrow 970. However, when manually pushed upwardly, as shown by arrow 980, the transmission assembly can be spaced from the spool 926. This allows a bag on the spool to be pulled out. If several bags are mounted on the spool, the next bag is immediately available when the previous bag is detached, as shown, e.g., in FIG. 17.

The invention has been described with reference to several preferred embodiments. Obviously, modifications and alterations will occur to others upon reading and understanding the preceding detailed description. It is intended that the invention be construed as including all such modifications and alterations as come within the scope of the appended claims on the equivalents thereof.

The invention claimed is:

1. A waste collection device, comprising:

a body including a housing defining an opening, said housing opening allowing an open end of an associated bag to be folded thereover and said housing receiving a closed end of said associated bag therein; and a motorized pulling mechanism connected to said body and removably connected to the associated bag by an elongated flexible connecting element for selectively pulling the associated bag into said housing.

2. The waste collection device of claim 1 wherein said motorized pulling mechanism includes:

a spool rotatably connected to said body and removably connected to said associated bag; and a driving mechanism connected to said spool for selectively rotating said spool such that the associated bag is wound on said spool thereby pulling said associated bag into said housing.

3. The waste collection device of claim 2 wherein said driving mechanism includes:

a motor for providing powered rotation to said spool; and a means for selectively connecting output of said motor to said spool so the spool is rotated by said motor when said motor is actuated.

4. The waste collection device of claim 3 wherein a handle of said body includes a switch thereon that actuates said motor when depressed.

5. The waste collection device of claim 3 wherein said means for selectively connecting output of said motor to said spool includes:

a gear driven by said motor upon actuation of said motor;

a spool gear engaged with said gear, said spool gear mounted for corotation with said spool so that rotation of said spool gear by said gear rotates said spool in a first direction; and means for disengaging said spool gear from said gear to allow manual rotation of said spool in a second direction.

6. The waste collection device of claim 5 wherein said spool gear is urged into engagement with said gear by a spring and said means for disengaging said spool gear from said gear comprises a knob that, upon application of sufficient force, overcomes the urging of said spring to displace said spool gear from engagement with said gear.

7. The waste collection device of claim 5 wherein said spool gear is only engaged with said gear when a sufficient force is applied to a knob on said handle and said means for disengaging said spool gear from said gear comprises a spring that urges said gear away from said spool gear.

8. The waste collection device of claim 2 wherein said spool defines a bag attachment slot having a large diameter portion connected to a small diameter portion, said large diameter portion being appropriately sized to receive a balled end of the associated bag and said small diameter portion being appropriately sized to hold onto the balled end when said spool is rotated in a first direction.

9. The waste collection device of claim 2 wherein said spool is removable from said body for attaching the associated bag to said spool.

10. The waste collection device of claim 1 wherein said motorized pulling mechanism includes:

a carriage disposed on said body and slidable in relation to said opening, said carriage being removably connected to the associated bag; and a driving mechanism connected to said carriage for selectively moving said carriage from a first position adjacent said opening to a second position spaced from said first position in a direction away from said opening to thereby pull the associated bag into said opening.

11. The waste collection device of claim 10 wherein said driving mechanism includes:

a motor for providing powered pulling of said carriage; and a transmission assembly for converting rotational power from said motor to linear movement of said carriage.

12. The waste collection device of claim 11 wherein said transmission assembly includes:

a connecting element connected at one end to said carriage; and a spool rotatably connected to said body and rotatable by said motor to wind said connecting element therearound and pull said carriage away from said opening.

13. The waste collection device of claim 12 further including:

a force transfer roller rotated by said motor upon actuation of said motor, said force transfer roller being frictionally engaged with said spool to rotate said spool; and means for disengaging said force transfer roller from said spool thereby allowing said spool to freely rotate.

14. The waste collection device of claim 13 wherein said force transfer roller is only engaged to said spool when a sufficient force is applied to a knob on said handle and said means for disengaging said force transfer roller from said spool comprises a spring that urges said force transfer roller away from said spool.

15. The waste collection device of claim. 10 wherein said carriage includes a structure that removably connects to the associated bag, said structure includes at least one of (1) a post for being received in an aperture of the associated bag and (2) a slot for receiving a balled end of the associated bag.

16. The waste collection device of claim 1 wherein the motorized pulling mechanism includes:

a motor removably connected to the associated bag for pulling the associated bag into said opening upon actuation of said motor.

17. The waste collection device of claim 16 further including:

one or more batteries operatively received in one of a handle mounted to said housing and said housing for providing power to said motor.

18. The waste collection device of claim 1 further comprising a handle mounted to said housing.

19. The waste collection device of claim 18 wherein said handle is a telescoping handle movable between a telescopingly folded-down position and a telescopingly extended position.

20. The waste collection device of claim 18 wherein said housing includes a base portion and said handle is pivotally attached to said base portion so that said handle is foldable into said base portion for compact storage.

21. The waste collection device of claim 20 wherein said housing is defined by said base portion and a frame pivotally mounted adjacent a forward end of said base portion, wherein in an open position said frame and said base portion together define said opening and in a closed position said frame pivots around said base portion for compact storage.

22. The waste collection device of claim 20 wherein said base portion includes a lower wall and a pair of spaced apart side walls extending upward from said lower wall, and wherein said handle is foldable against said lower wall.

23. The waste collection device of claim 1 further including:

a door movable between an open position and a closed position wherein the door closes said opening and pinches the associated bag received in said opening closed.

24. The waste collection device of claim 1 wherein said housing includes:

a main housing; and a housing attachment that is removable from said main housing portion.

25. The waste collection device of claim 1 further comprising a light source connected to said housing and positioned for providing light adjacent said opening of said housing.

26. The waste collection device of claim 25 further including a switch for selectively actuating said light source.

27. The waste collection device of claim 1 further including:

a storage compartment on said body for holding a supply of the associated bags.

28. A waste collection device, comprising:

a body including a housing portion defining an opening;

a liner bag having a closed end and an open end, said closed end being received in said opening and said open end being folded over said housing portion opening; and a spool rotatably connected to said body and removably connected to said closed end of said liner bag, wherein a rotation of said spool in a first direction pulls said liner bag into said opening.

29. The waste collection device of claim 28 further including:

a motor mounted to said body and operatively connected to said spool for powered rotation of said spool in said first direction; and a switch for actuating said motor.

30. The waste collection device of claim 29 further comprising a first knob which activates said switch and connects said motor to said spool upon application of a sufficient force thereto so that said motor rotates said spool.

31. The waste collection device of claim 30 further including:

a second knob for disconnecting said spool from said motor upon application of a sufficient force thereto so that said spool is freely rotatable in a second direction.

32. The waste collection device of claim 28 further including:

a carriage to which said closed end of said liner bag is attached;

a connecting element connecting said carriage to said spool, said connecting element winding on said spool when said spool is rotated in said first direction thereby pulling said carriage away from said opening.

33. The waste collection device of claim 28 wherein said liner bag includes a sheet secured at said closed end of said liner bag.

34. The waste collection device of claim 33 wherein said sheet comprises an absorbent material for absorbing liquids.

35. The waste collection device of claim 28 further including:

a roll of liner bags rotatably connected to said body, said liner bag being attached to said roll of liner bags so that upon disposal of a first of said liner bags a second liner bag from said roll of liner bags is readily usable.

36. A waste collection device, comprising:

a body defining an opening;

a liner having a closed end received in said opening and an open end received about said body adjacent said opening;

a spool rotatably mounted in said body and connected to said liner so that upon rotation of said spool in a first direction said liner is pulled into said body; and a motor mounted to said body and selectively connected to said spool for powered rotation of said spool in said first direction.

37. The waste collection device of claim 36 wherein at least one wheel is rotatably mounted to said body for facilitating movement of said body on a surface.

38. A method of collecting waste comprising:

providing a housing with an opening and a motorized pulling mechanism located in the opening;

mounting a liner bag having a closed end and an open end to said body such that said bag closed end is located in said opening;

connecting the bag closed end with the motorized pulling mechanism;

folding said bag open end over said body opening;

positioning the bag open end adjacent waste material meant to be collected, the waste material being located on a surface;

pulling the bag further into the housing with the motorized pulling mechanism; and simultaneously transferring the waste material from the surface into the bag.

39. The method of claim 38 further comprising the steps of:

detaching the bag closed end from the pulling mechanism; and removing the bag from the housing.

40. A waste collection device, comprising:

a body including a housing defining an opening and a movable handle mounted to the housing, said housing opening allowing an open end of an associated bag to be folded thereover and said housing receiving a closed end of said associated bag therein; and a pulling mechanism connected to said body and removably connected to the associated bag for selectively pulling the associated bag into said housing, wherein said pulling mechanism includes a spool rotatably connected to said body and removably connected to said associated bag; and a driving mechanism connected to said spool for selectively rotating said spool such that the associated bag is wound on said spool thereby pulling said associated bag into said housing.

* * * * *